US010946398B2

(12) United States Patent
MacLean-Blevins et al.

(10) Patent No.: US 10,946,398 B2
(45) Date of Patent: Mar. 16, 2021

(54) SPRAY APPARATUS WITH FLOW TUBE ASSEMBLY

(71) Applicant: Green Garden Products Company, LLC, Bedford, PA (US)

(72) Inventors: Mark T. MacLean-Blevins, Westminster, MD (US); Adam Conrad Faupel, Schellsburg, PA (US)

(73) Assignee: GREEN GARDEN PRODUCTS COMPANY, LLC, Bedford, PA (US)

( * ) Notice: Subject to any disclaimer, the term of this patent is extended or adjusted under 35 U.S.C. 154(b) by 18 days.

(21) Appl. No.: 16/166,615

(22) Filed: Oct. 22, 2018

(65) Prior Publication Data

US 2019/0118202 A1 Apr. 25, 2019

Related U.S. Application Data

(60) Provisional application No. 62/575,010, filed on Oct. 20, 2017.

(51) Int. Cl.

| | |
|---|---|
| ***B05B 7/00*** | (2006.01) |
| ***B05B 7/24*** | (2006.01) |
| ***B05B 7/04*** | (2006.01) |
| ***B05B 7/12*** | (2006.01) |
| ***B05B 1/26*** | (2006.01) |
| ***B05B 1/12*** | (2006.01) |

(52) U.S. Cl.

CPC ..... *B05B 7/2443* (2013.01); *B05B 1/12* (2013.01); *B05B 1/267* (2013.01); *B05B 7/0408* (2013.01); *B05B 7/12* (2013.01)

(58) Field of Classification Search

CPC ..... B05B 1/12; B05B 7/2443; B05B 7/0408; B05B 7/12; B05B 11/3011; B05B 15/65

USPC ... 239/8, 318, 353, 354, 414, 407, 569, 583, 239/526; 251/1; 137/1, 854

See application file for complete search history.

(56) References Cited

U.S. PATENT DOCUMENTS

| | | | | |
|---|---|---|---|---|
| 1,868,518 A | | 7/1932 | Breuer | |
| 4,527,740 A | * | 7/1985 | Gunzel, Jr. | B05B 7/2443 239/318 |
| D445,872 S | | 7/2001 | Ketcham et al. | |
| 6,749,133 B1 | * | 6/2004 | Ketcham | B05B 7/12 137/894 |

(Continued)

OTHER PUBLICATIONS

International Search Report and Written Opinion for Corresponding International Application No. PCT/US18/56862 dated Dec. 21, 2018.

*Primary Examiner* — Qingzhang Zhou
(74) *Attorney, Agent, or Firm* — Reed Smith LLP

(57) ABSTRACT

The invention relates to a hose end sprayer configured for connecting to a hose and at least one container. The hose end sprayer includes a main housing sub-assembly having a main housing bore, a flow tube assembly and a nozzle. The flow tube assembly is disposed within the main housing bore and slideably displaceable relative thereto between a first position allowing delivery of neither of the first substance and the second substance through the main bore outlet, and a second position allowing delivery of a mixture of the first and second substances through the main bore outlet. The nozzle includes an interference member configured to selectively interfere with the downstream end of the flow tube assembly when the flow tube assembly is in the second position.

29 Claims, 29 Drawing Sheets

(56) References Cited

U.S. PATENT DOCUMENTS

| | | | | |
|---|---|---|---|---|
| 7,083,125 | B2 * | 8/2006 | Westphal | B65D 83/203 239/525 |
| 2004/0182393 | A1 | 9/2004 | MacMillan et al. | |
| 2013/0048761 | A1 | 2/2013 | Hudson et al. | |
| 2013/0193226 | A1 | 8/2013 | Uschold et al. | |

* cited by examiner

SPRAY APPARATUS WITH FLOW TUBE ASSEMBLY

CROSS-REFERENCE TO RELATED APPLICATION

This application claims the benefit under 35 U.S.C. § 119(e) of the earlier filing date of U.S. Provisional Patent Application No. 62/575,010 filed on Oct. 20, 2017, the disclosure of which is incorporated by reference herein.

BACKGROUND

Sprayers are commonly employed to apply diluted solutions containing chemicals such as pesticides, fungicides, herbicides, and fertilizers to lawns or garden foliage. Typically, sprayers are attached to a garden hose.

In the case of the liquid chemical aspiration sprayer, the pressure of the water delivered by the hose through the sprayer creates a negative pressure gradient or venturi that causes the chemical solution to be aspirated into the water stream, thereby providing a dilated solution to be sprayed.

In general, the liquid chemical aspiration sprayers include a container for holding the chemical solution to be diluted and sprayed and a sprayer/mixing head. The base portion of the sprayer head serves as a cover for the chemical container. Such sprayer heads generally include an adapter for connecting the sprayer head to a standard garden hose, and a hand valve for turning on and off the flow of water from the garden hose. The sprayer head also includes an aperture over which water from the garden hose passes to mix with undiluted chemical solution from the container. Such sprayer heads may also include a venturi chamber in which the water from the garden hose mixes with the chemical from the container.

In principle, as water passes over the aperture or through the venturi chamber, a siphoning or vacuum action is created by virtue of the velocity of the water passing over the aperture or through the chamber, to draw chemical from the container into the water stream for dilution.

Prior hose end sprayers, such as disclosed in U.S. Pat. Nos. 6,749,133 and D445872 which are incorporated herein by this reference, included a resilient inner insert tube, used to flow the water and proportion in the liquid product desired to be diluted by the water. Such a resilient inner insert tube can be somewhat difficult to move within the rigid polypropylene housing. The resilient materials used to form the inner tube, or flow tube, typically function well when first assembled but become more difficult to move over time. The problem seemed to become worse the longer the product would stay dormant after initial assembly. A need for a spraying apparatus that provides superior aspiration and easier to operate functionality has thus developed.

DETAILED DESCRIPTION

Embodiments of the invention are discussed below with reference to the Figures. However, those skilled in the art will readily appreciate that the detailed description given herein with respect to these figures is for explanatory purposes as the invention extends beyond these limited embodiments.

Features which are described in the context of separate embodiments may also be provided in combination in a single embodiment. Conversely, various features which are, for brevity, described in the context of a single embodiment, may also be provided separately or in any suitable subcombination.

It is to be understood that any exact measurements/dimensions or particular construction materials indicated herein are solely provided as examples of suitable configurations and are not intended to be limiting in any way. Depending on the needs of the particular application, those skilled in the art will readily recognize, in light of the following teachings, a multiplicity of suitable alternative implementation details.

This application discloses an invention which is related, generally and in various embodiments, to a sprayer. Disclosed herein is a sprayer having a flow tube assembly for which provides superior aspiration and easier to operate functionality than prior sprayers. In addition, an exterior shroud is disclosed giving the spraying apparatus an entirely new appearance. As part of this exterior "skin" a flow altering nozzle is disclosed. This nozzle is configurable for either a straight (long reach) stream delivery or for a wide fan (short wide area coverage) allowing the end user great flexibility in the use of the sprayer.

Referring to FIGS. 1-22, there is shown a sprayer 16 having a flow tube assembly 1, a main housing sub-assembly 10, and an external shroud 26.

Figure 1:
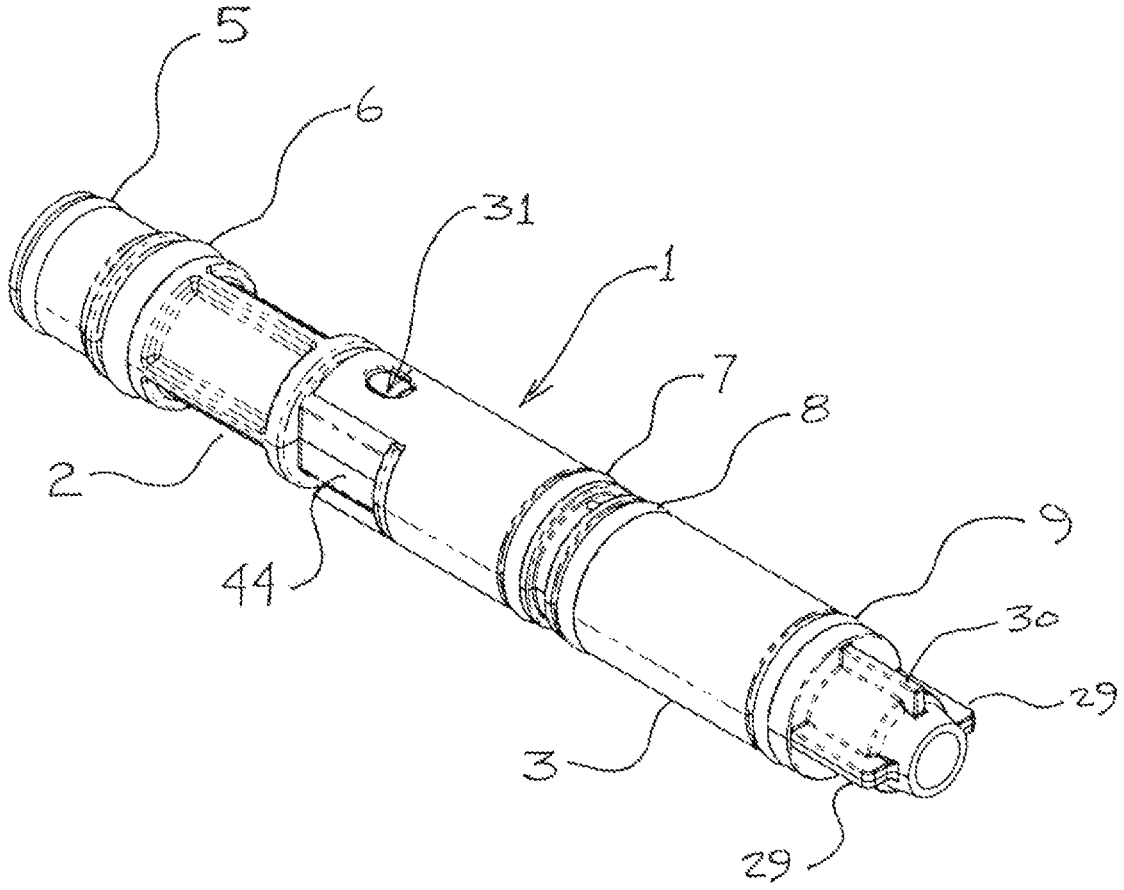
FIG. 1 shows the two-piece flow tube assembly as assembled.
Figure 2:
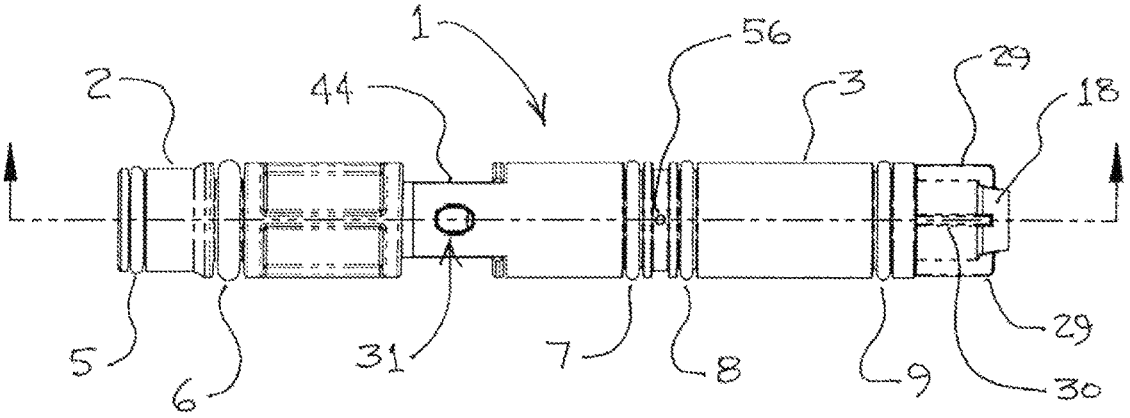
FIG. 2 shows a top view of the two-piece flow tube assembly
Figure 2A:
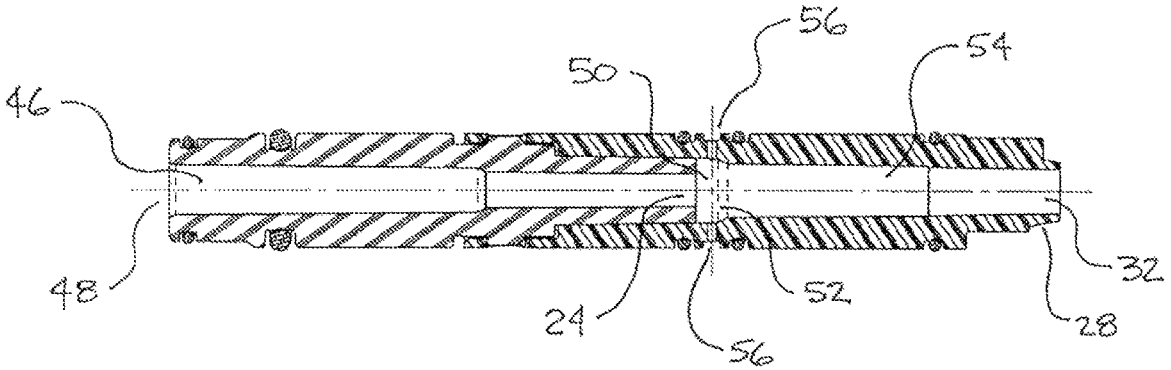
FIG. 2A shows a cross-sectional view taken from FIG. 2
Figure 3:
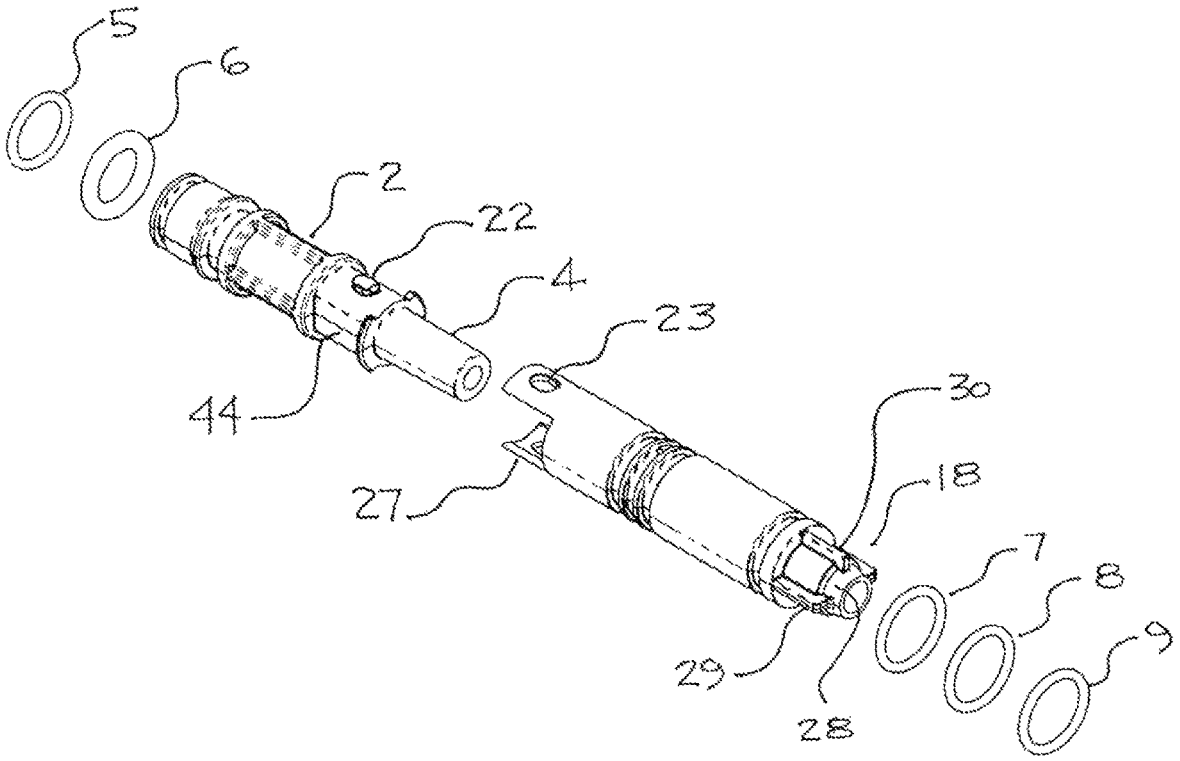
FIG. 3 shows an exploded two-piece flow tube assembly.
Figure 10:
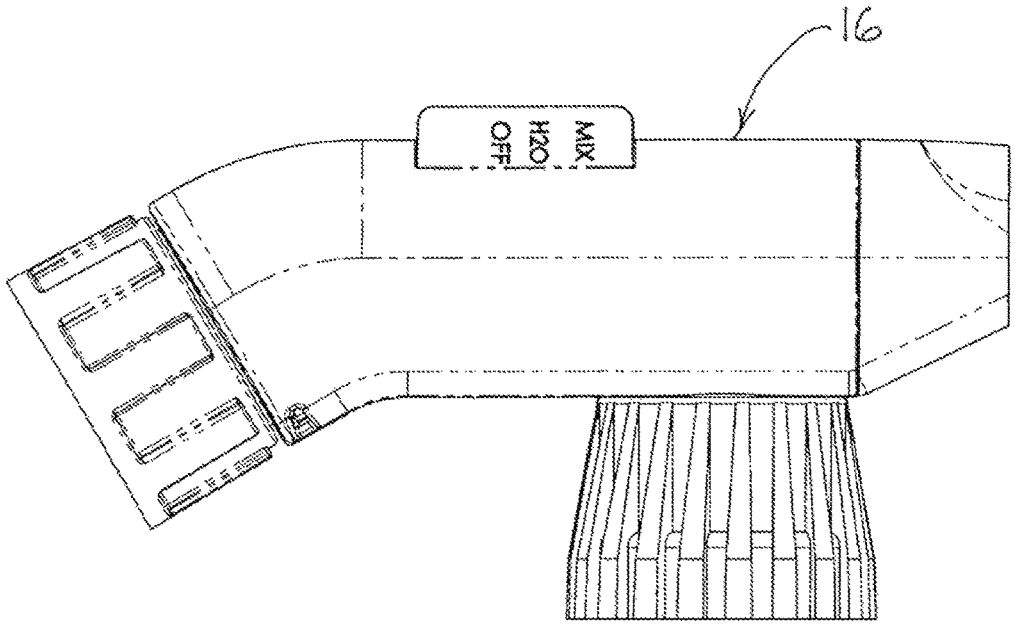
FIG. 10 shows a side view of the assembled sprayer in the ON/MIX position.
Figure 13:
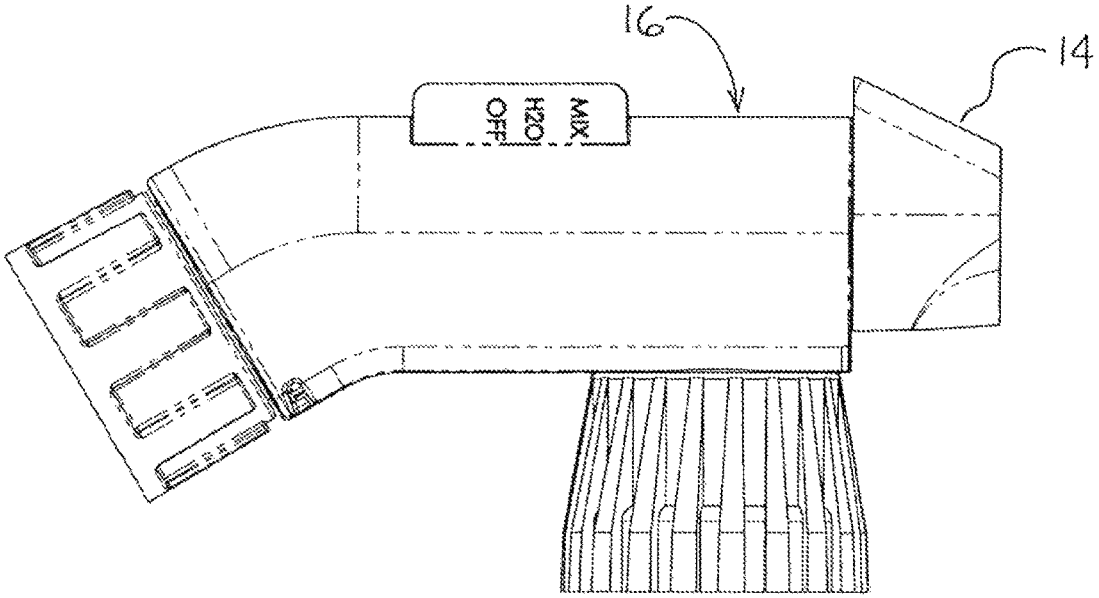
FIG. 13 shows a side view of the assembled sprayer in the ON/MIX position with the nozzle rotated to the straight stream position.

Referring to FIGS. 1-3, flow tube assembly 1 is a two piece assembly having an upstream flow tube assembly member 2, and a downstream flow tube assembly member 3. Flow tube assembly 1 is moveable within main housing sub-assembly 10 from an upstream OFF position (FIGS. 8, 11, and 14) to an intermediate $H_2O$ (water) ONLY position (FIGS. 9, 12, and 15) to a downstream ON/MIX position (FIGS. 10, 13, and 16). Upstream flow tube assembly member 2 includes a tapered male seal end 4 which is adapted to be insertable into female seal end 27 of downstream flow tube assembly member 3. Downstream flow tube assembly member 3 has a tip 18 having a tapered end 28 and radially spaced locating ribs 29, 30. Locating ribs 29, 30 cooperate with nozzle 14 when flow tube assembly 1 is in the ON/MIX position so the nozzle 14 will not rotate while in operation. When flow tube assembly 1 is in the OFF position, locating ribs 29, 30 disengage with nozzle 14 so nozzle 14 is allowed to rotate allowing the user to select between a wide disposed spray pattern or a long reaching straight stream delivery of the diluted and mixed liquid. Flow tube assembly 1 further includes a number of seal members in the form of standard elastomeric O-rings to provide the sealed operation formerly provided by the resilient flow tube molding itself. Specifically, upstream flow tube assembly member 2 has two O-rings 5, 6, used to isolate and control the flow of the carrier stream entering the sprayer from the source and downstream flow tube assembly member 3 has three O-rings 7, 8, 9. The two downstream-most O-rings 8 and 9 isolate and control the atmospheric vent for the container. The O-rings 5, 6, 7, 8, 9 are positioned to provide the proper squeeze required at each seal without creating too much drag force during user operation of the device. Flow tube assembly 1 further has a series of chambers defined within flow tube assembly 1. A first, mildly tapered cylindrical chamber 46 preferably extends from inlet flow bore 48 in upstream flow tube assembly member 2 to a throttle exit 24 having a smaller diameter than the upstream end 48. A short cylindrical venturi chamber 50 is formed by the terminal end of flow tube assembly member 2 and the inner geometry of flow tube assembly member 3. This venturi chamber 50 has a much larger cross-sectional area than the throttle exit 24 which acts to slow the carrier stream velocity and in turn decrease the system pressure within that chamber. This velocity decrease and corresponding pressure decrease (as defined by Bernouli's law) results in a less than atmospheric pressure condition within venturi chamber 50 (commonly understood as a vacuum). Flow tube assembly member 3 receives the carrier stream flow through venturi chamber 50 along with the injected concentrated liquid product flow through apertures 56 situated on flow tube assembly member 3. This combined mixed fluid then is driven through a frustoconical transition chamber 52, then, through a mildly tapered outlet chamber 54 of decreasing diameter extending to an outlet flow bore 32 at tip 18. This chamber 54 has a specific and distinct diameter range which allows free fluid flow through the device without undue hack pressure, while at the same time is not so large as to allow atmospheric air to enter backwards from the exit port of the device. Downstream flow tube assembly member 3 further has said apertures 56 disposed between O-rings 7 and 8, said apertures leading to the interior of short formed cylindrical chamber 50.

Flow tube assembly 1 is molded, cast or otherwise constructed from a suitable material such as a rigid polypropylene.

Since the two-piece flow tube assembly 1 is moved within main housing sub-assembly 10 to operate the sprayer 16, the assembly of the two pieces must be secured to prevent them from disassembly during use. This is accomplished by a latch assembly 31 that when inserted into a bore 25 of the main housing sub-assembly 10 is prevented from unlatching, thereby securing flow tube assembly members 2, 3 one to the other so they function operationally as a single unit. The tapered male seal end **4*a* and tapered female receiver bore 4*b* between flow tube assembly members 2, 3 provides an air-tight seal that acts as a vacuum seal, when in operation. The pressure drop at the venturi chamber 50, winch produces the lower than atmospheric pressure condition, may cause the two flow tube assembly members 2, 3 to actually pull together, or tighten, the tapered male seal end 4*a* and tapered female bore 4*b* surfaces, further enhancing the seal integrity during use. A latch assembly 31 latches the flow tube assembly members 2, 3 together. In the illustrated embodiment, latch assembly 31 includes a pair of oval boss projections 22 on upstream flow tube assembly member. Oval boss projections 22 are disposed upstream of tapered, male seal end 4*a*. Latch assembly 31 further includes a pair of oval slots 23 on downstream flow tube assembly member 3. Latch assembly 31 allows the installation of the O-rings 5, 6, 7, 8, 9 prior to insertion of the flow tube assembly 1 into the sprayer main housing bore 25. Once inserted into the main housing bore 25 of main housing sub-assembly 10, the latch assembly 31 is trapped between the moving flow tube assembly 1 and the inner diameter of the main housing bore 25, preventing the latch assembly 31 from becoming dislodged during use of the sprayer 16. This molded in integral latch assembly 31 with the support and entrapment by the main housing bore 25 is inexpensive to produce, easy to assemble, and performs exceptionally well. The nature of the two piece design allows the venturi chamber 50 to be precisely formed, allows the throttle exit 24 to be precisely controlled during manufacturing, and allows the outlet flow bore 32 at tip 18 to be arranged to provide the necessary flow length to establish the optimum flow characteristics required for long-reach straight stream spray applications. Hydraulic testing of this flow tube assembly 1** has proven the design intent and the venturi system of this design is producing pressure drops of a larger magnitude than prior sprayers.

Figure 4:
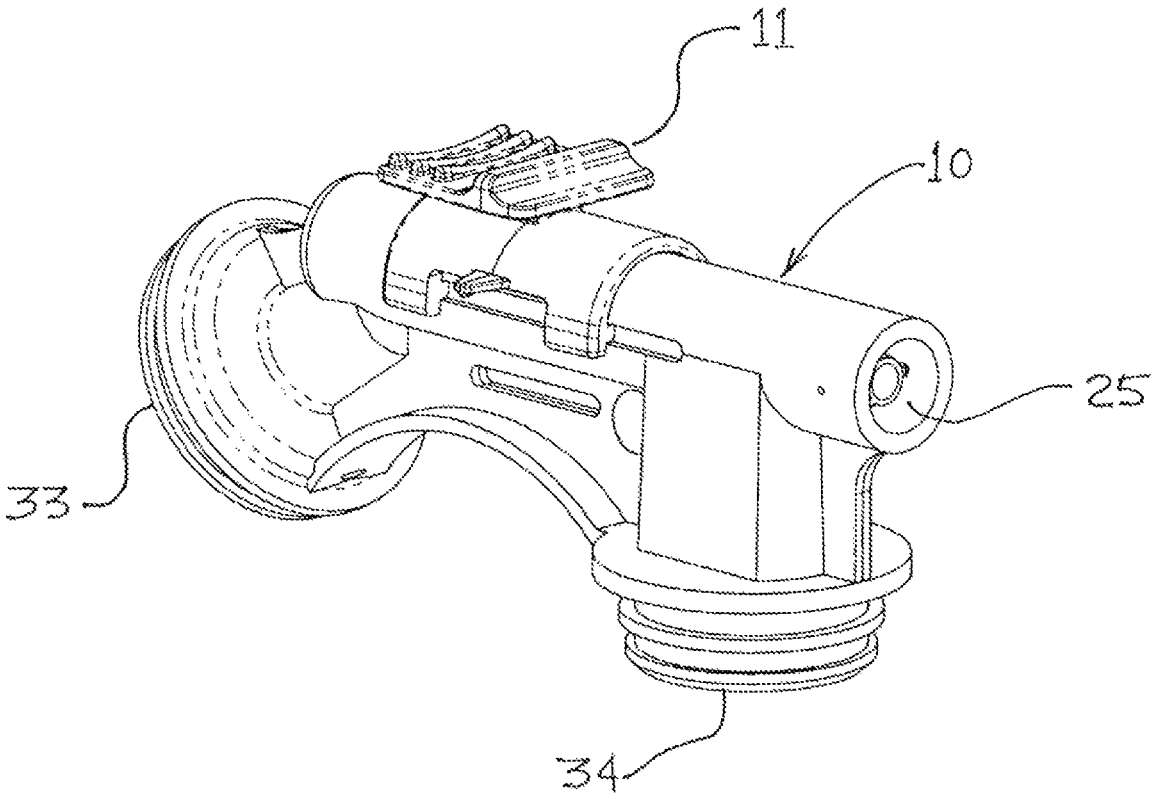
FIG. 4 shows the main housing sub-assembly.
Figure 5:
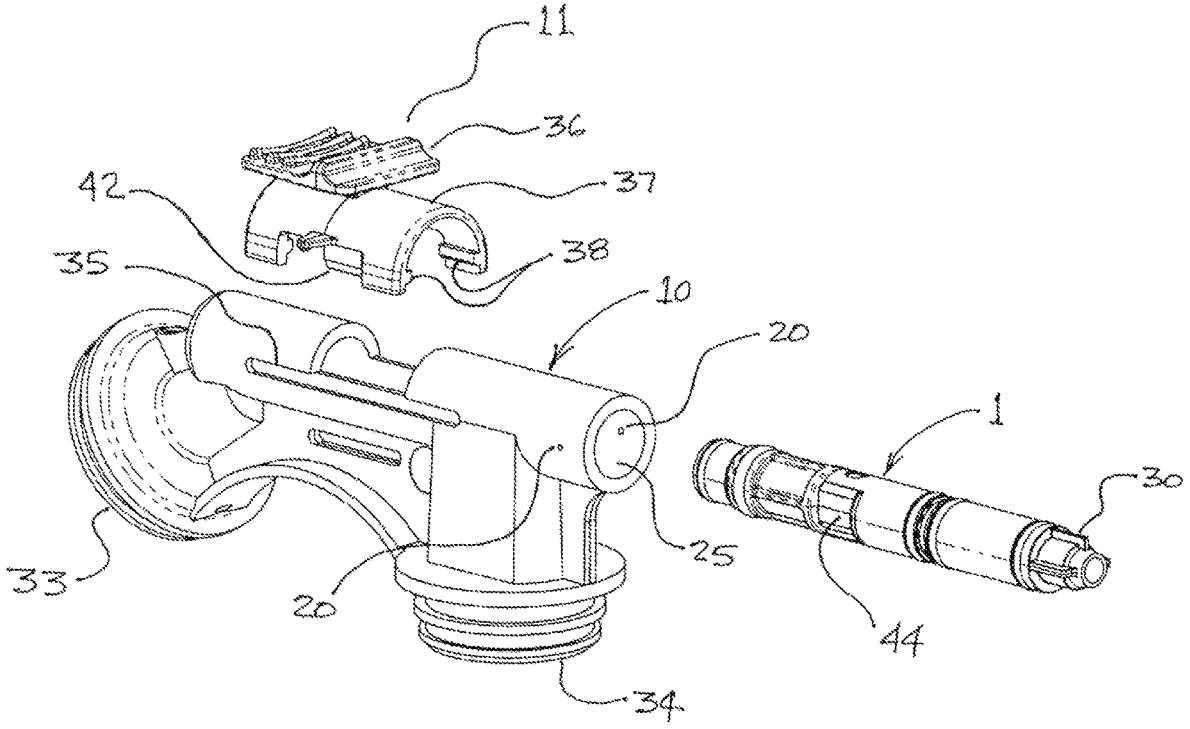
FIG. 5 shows the main housing sub-assembly with the two-piece flow tube assembly prior to being inserted into the main housing sub-assembly and the actuator prior to being snapped onto the main housing sub-assembly.
Figure 6:
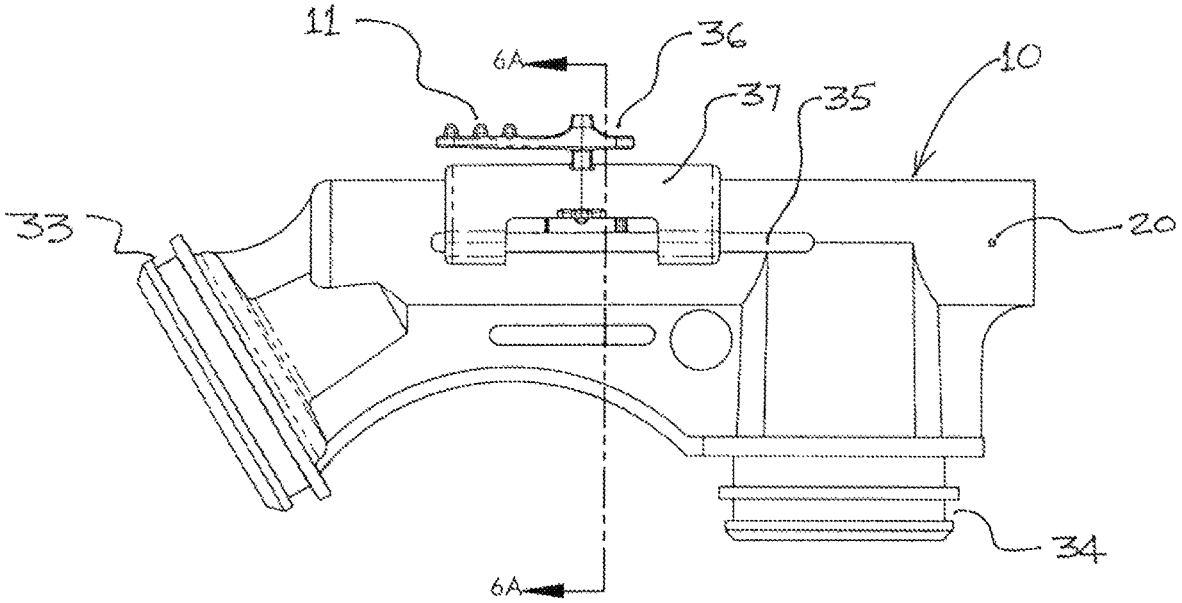
FIG. 6 shows a side view of the main housing sub-assembly.
Figure 6A:
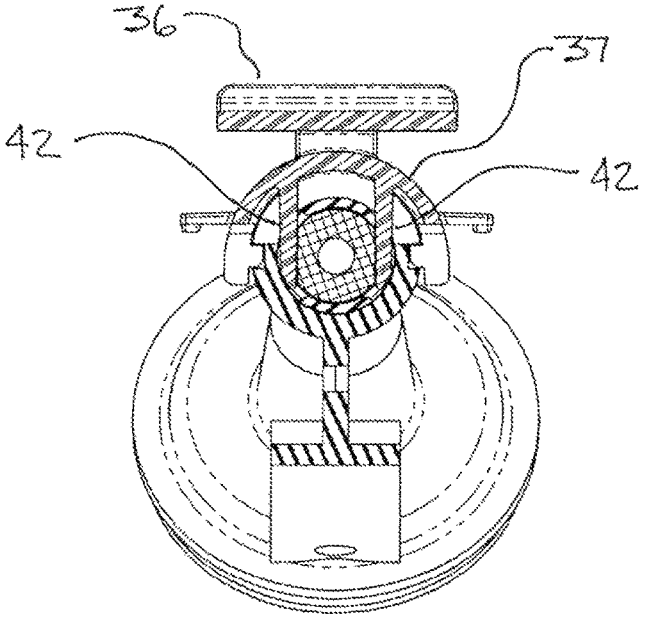
FIG. 6A shows a cross-sectional view taken from FIG. 6.
Figure 13A:
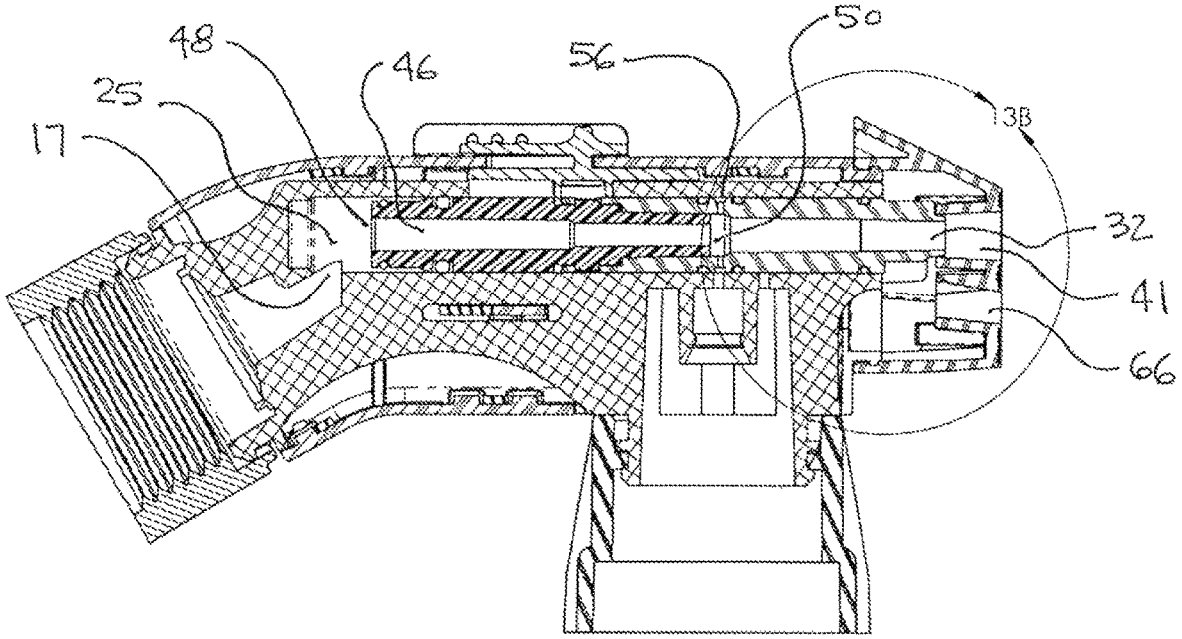
FIG. 13A shows a cross-sectional view of the assembled sprayer of FIG. 13.

Referring to FIGS. 4-6, main housing sub-assembly 10 includes an actuator 11, the main housing bore 25, a threaded hose end snap attachment 33 and a threaded container snap attachment 34. Main housing sub-assembly 10 further includes a water inlet port 17 (FIGS. 10A and 13A) disposed at the threaded hose attachment 33. Main housing sub-assembly 10 further includes a chemical inlet port 58 which selectively allows fluidic communication with a chemical container (not shown) to which the sprayer 16 is attached to allow chemicals or other substances from the chemical container into the stream of water or other substances from a hose (not shown) connected to threaded hose attachment 33 for dilution. This chemical container is placed in fluid communication with apertures 56 in downstream flow tube assembly member 3 when assembled to sprayer 16. Main housing sub-assembly 10 further includes atmospheric vent holes 60 which are in fluid communication with the inside of the chemical container and can be selectively placed in fluid communication with outside atmosphere through the main housing bore 25 through vent ports 20 in housing sub-assembly 10. Main housing sub-assembly 10 further includes a pair of grooves 35, one on either side of main housing sub-assembly 10. Actuator 11 includes a thumb actuator portion 36 attached to a semi-cylindrical portion 37. Semi-cylindrical portion 37 includes opposed projections 38 on the bottom portion thereof which cooperate with grooves 35 to allow semi-cylindrical portion 37 to move linearly along the bore axis of main housing sub-assembly 10. The inner diameter of main housing bore 25 is only slightly larger than the outer diameter of the two-piece flow tube assembly 1. In one embodiment, this clearance can be about 0.003 inches per side which will not allow the latch assembly 31 on the two-piece flow tube assembly 1 which can have a thickness of about 0.027 inches to unlatch. Semi-cylindrical portion 37 further includes prongs 42 (FIG. 7) which are adapted to mate fully with the prong receiver recesses 44 on flow tube assembly 1. In operation, movement of thumb actuator portion 36 by a user will cause the entire flow tube assembly to move as one unit with the thumb actuator, allowing the user direct fluid flow control and operation through the thumb actuator motion.

Figure 7A:
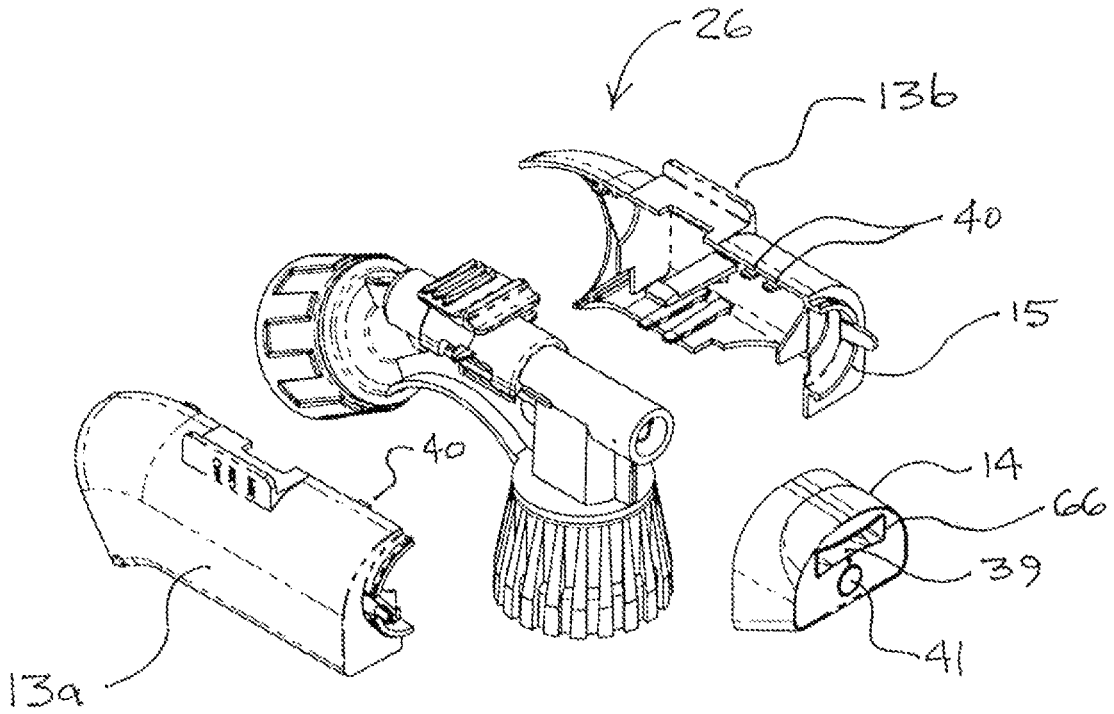
FIGS. 7A, 7B, 7C show views of an exploded sprayer and nozzle.
Figure 7B:
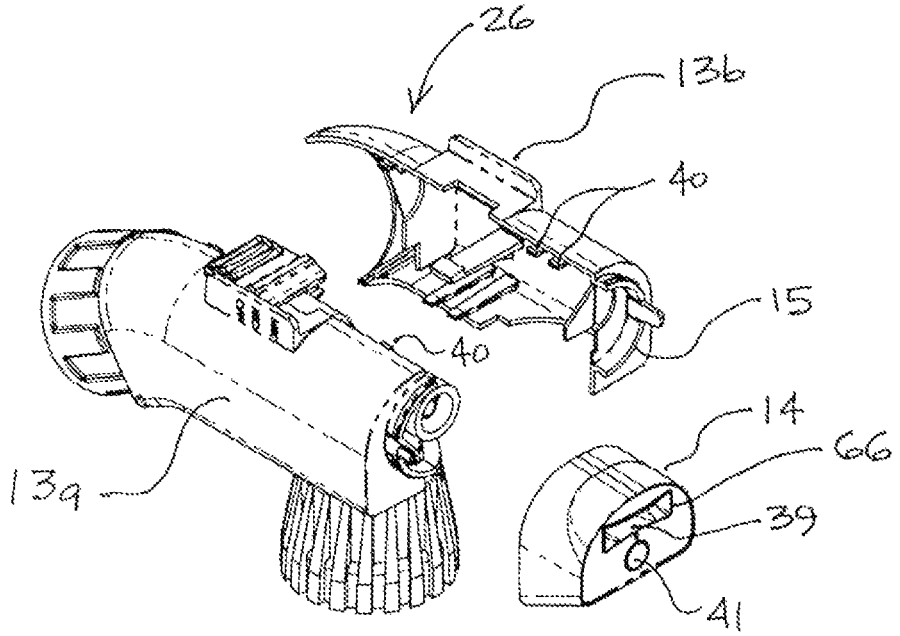
Figure 7C:
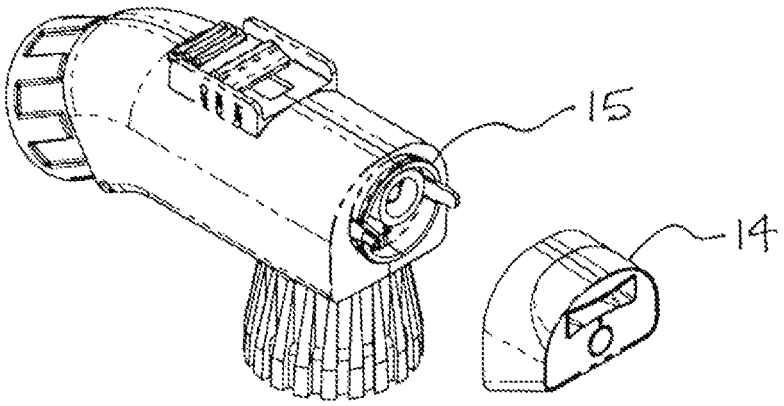
Figure 7D:
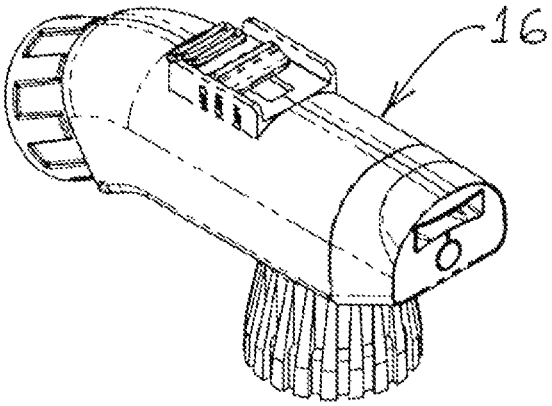
FIG. 7D shows an assembled sprayer and nozzle.

Referring to FIGS. 7A, 7B, 7C, the external shroud 26 is a three-piece assembly comprising two side covers 13*a*, 13*b* and a nozzle 14. Nozzle 14 includes a cam ramp 19 disposed on the upstream end of a convex tapered flow deflecting surface 39 on an interior portion thereof (FIGS. 8B, 9B, 10B, 11B, 12B and 13B). The two side cover parts 13*a*, 13*b* include snap elements 40 to snap on to the main housing sub-assembly 10 and a circular snap bead element 15 provided onto which nozzle 14 is snapped, such that no fasteners or secondary operations required. Once snapped into position over the two side covers 13*a*, 13*b*, nozzle 14 helps to hold the two side covers 13*a*, 13*b* in position on the main housing sub-assembly 10. In addition, the snap feature geometry between the side covers 13*a*, 13*b* and the nozzle 14 allows the nozzle 14 to rotate relative to the sprayer 16. The nozzle 14 can be rotated to two different portions, 180 degrees apart. One position allows the stream to exit the flow tube assembly 1 untouched through a straight stream nozzle opening 41 as a straight stream for extreme spray reach. The other nozzle position places a dispersed spray nozzle opening 66 having a convex tapered flow deflecting surface 39 directly in the path of the flow from the exit bore 32 of flow tube assembly 1 causing the flow to be interrupted, resulting in a wide dispersed spray pattern, sometimes referred to as a fan spray pattern.

Figure 10A:
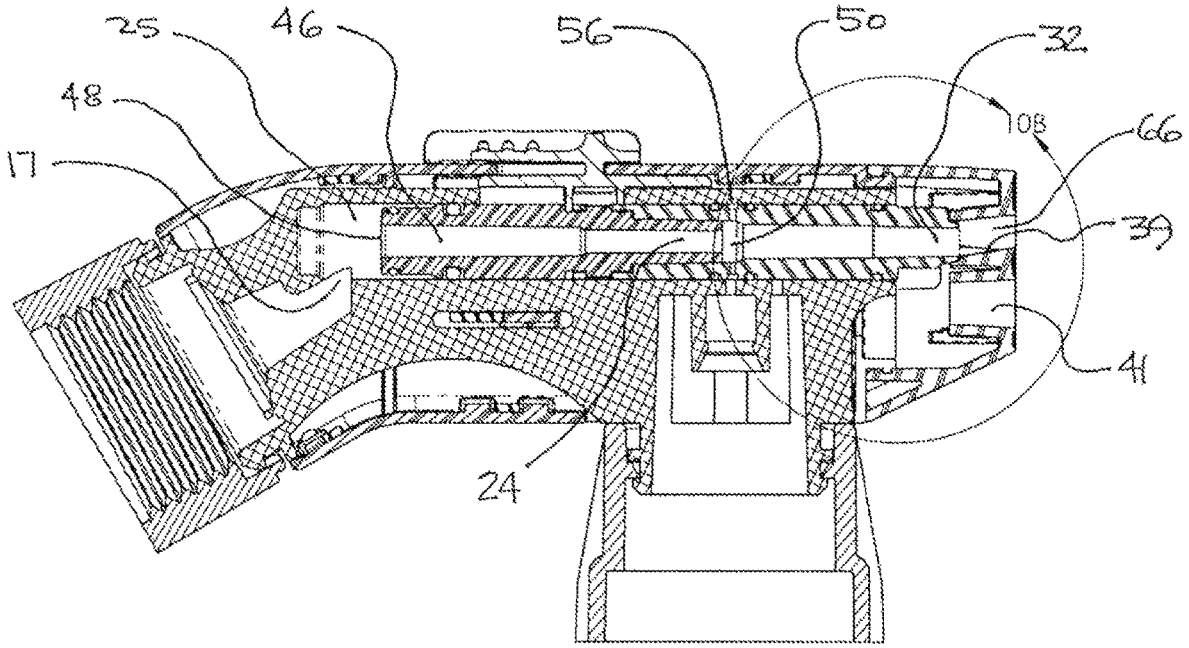
FIG. 10A shows a cross-sectional view of the assembled sprayer of FIG. 10
Figure 10B:
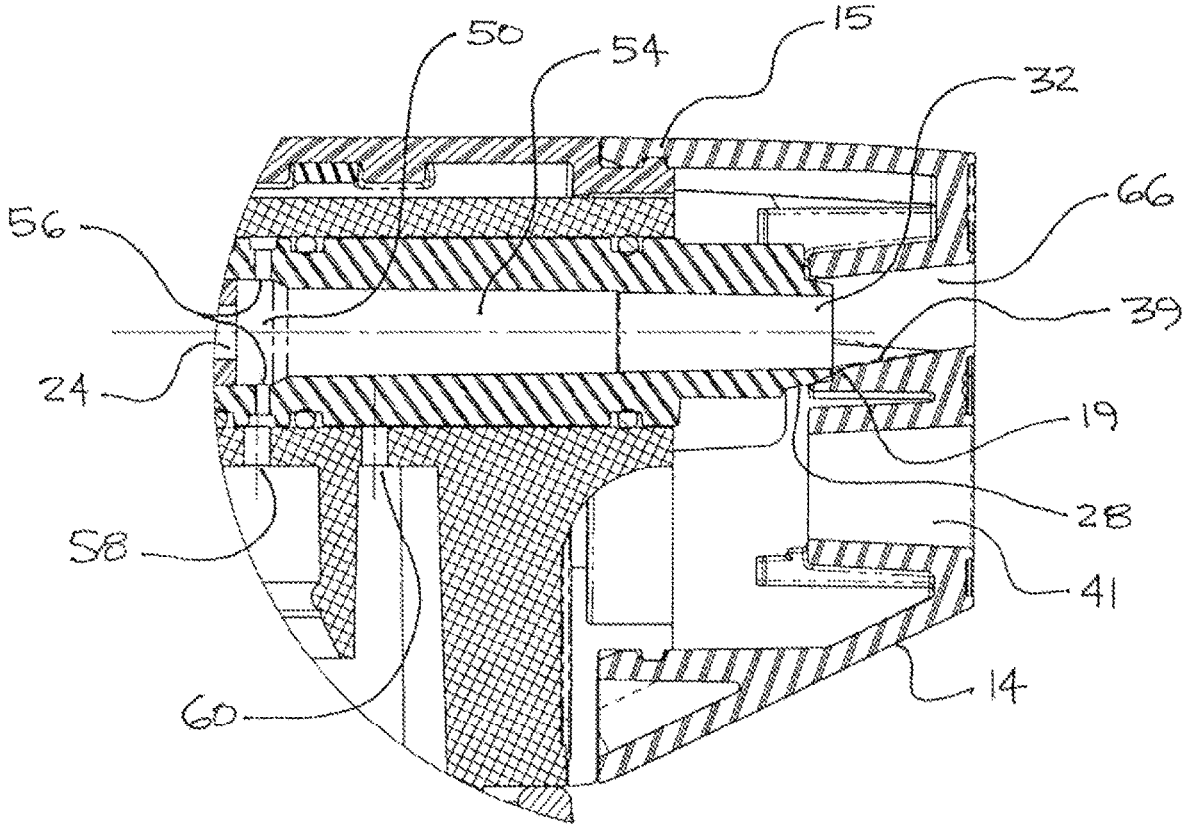
FIG. 10B allows a detailed view of area 10B of FIG. 10A.
Figure 11:
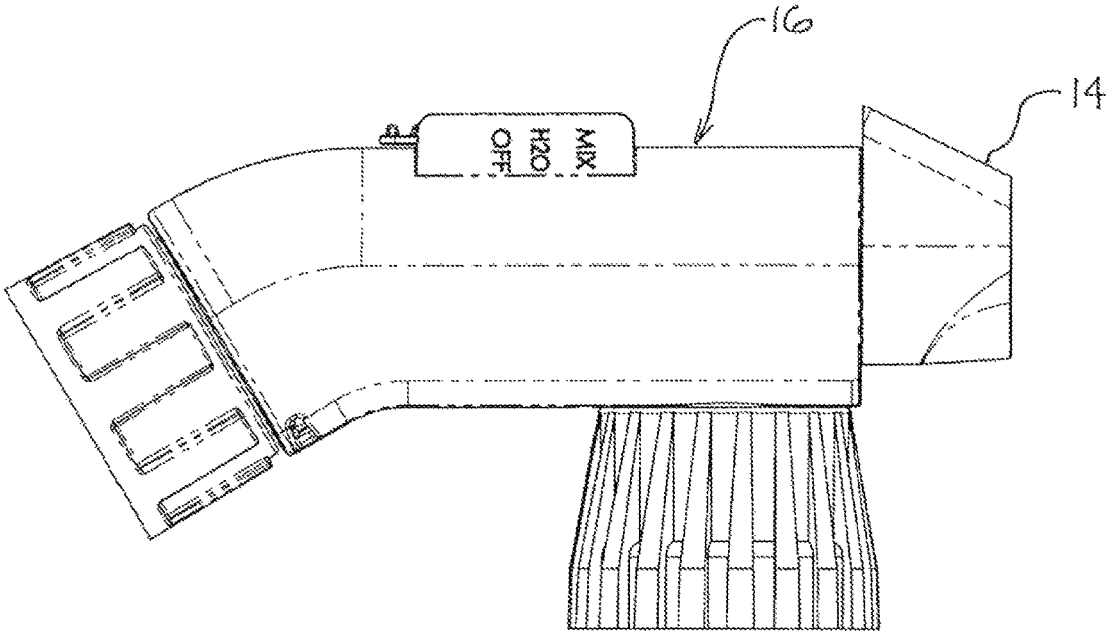
FIG. 11 shows a side view of the assembled sprayer in the OFF position with the nozzle rotated to the straight stream position.
Figure 11A:
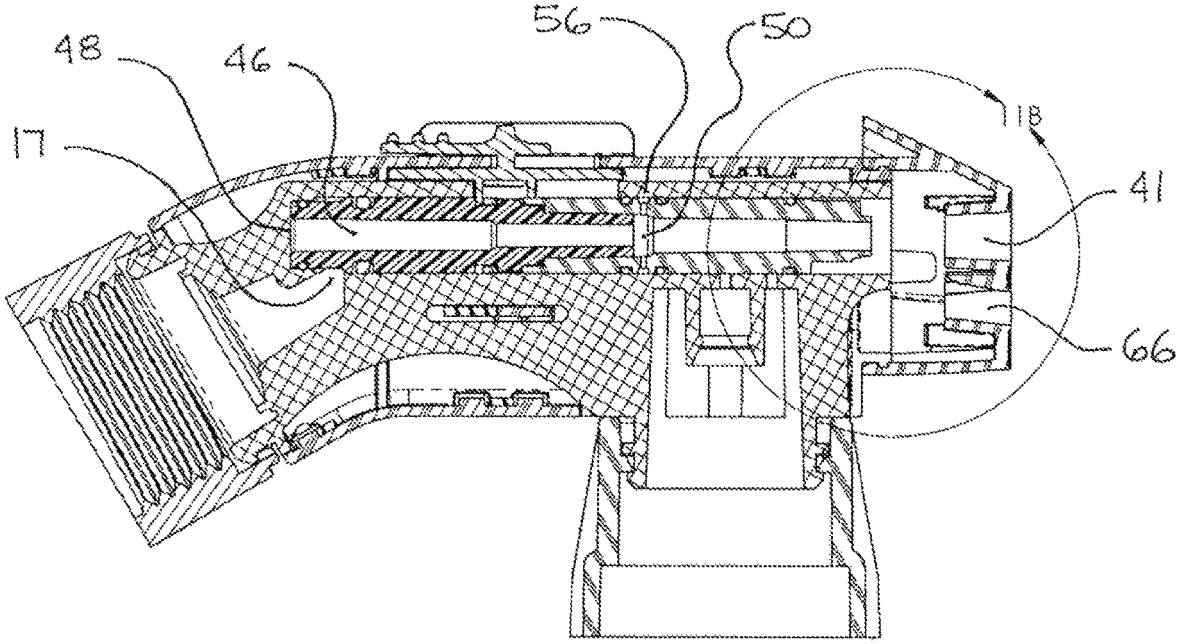
FIG. 11A shows a cross-sectional view of the assembled sprayer of FIG. 11.
Figure 11B:
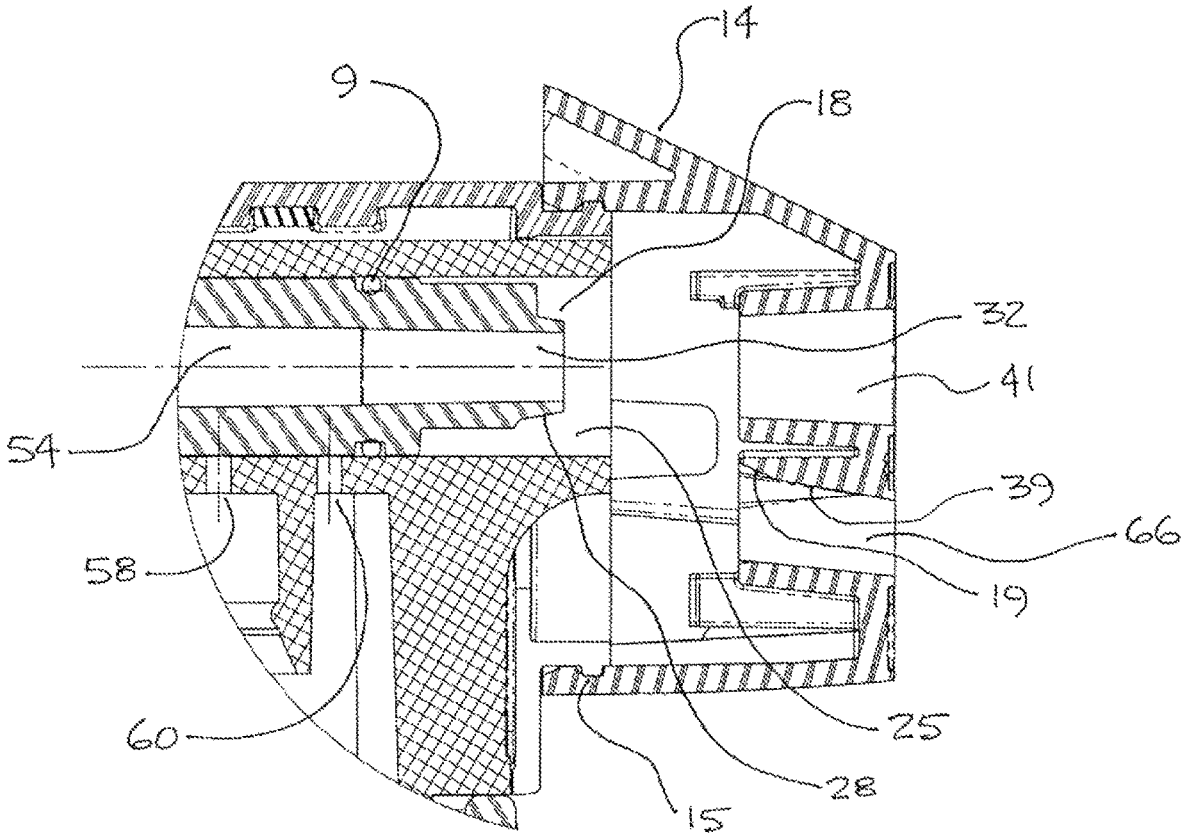
FIG. 11B shows a detailed view of area 11B of FIG. 11A.
Figure 12:
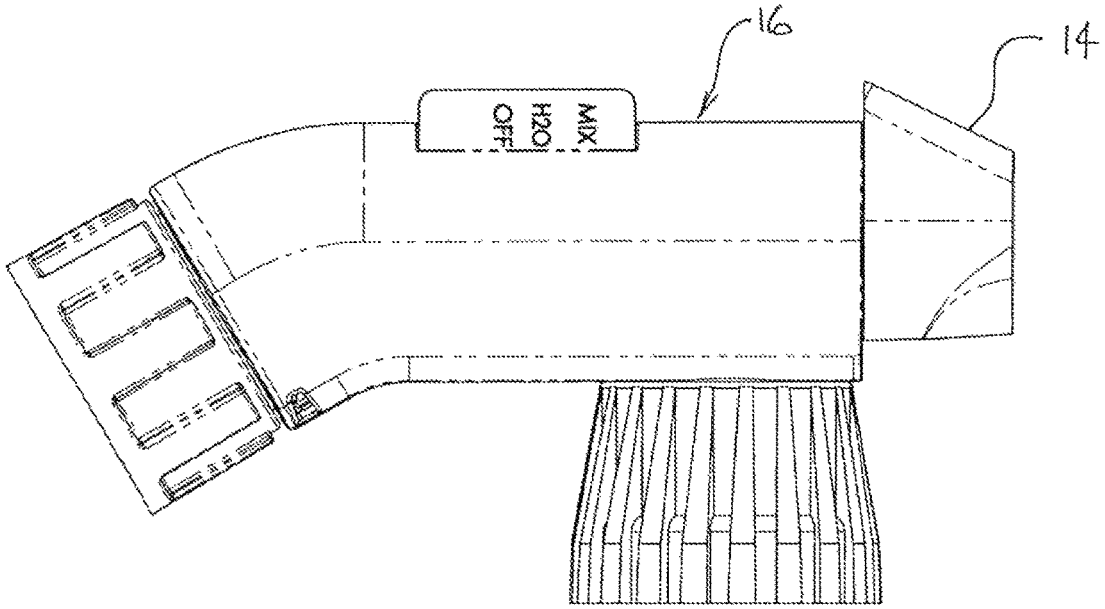
FIG. 12 shows a side view of the assembled sprayer in the H2O (water) Only position with the nozzle rotated to the straight stream position.
Figure 12A:
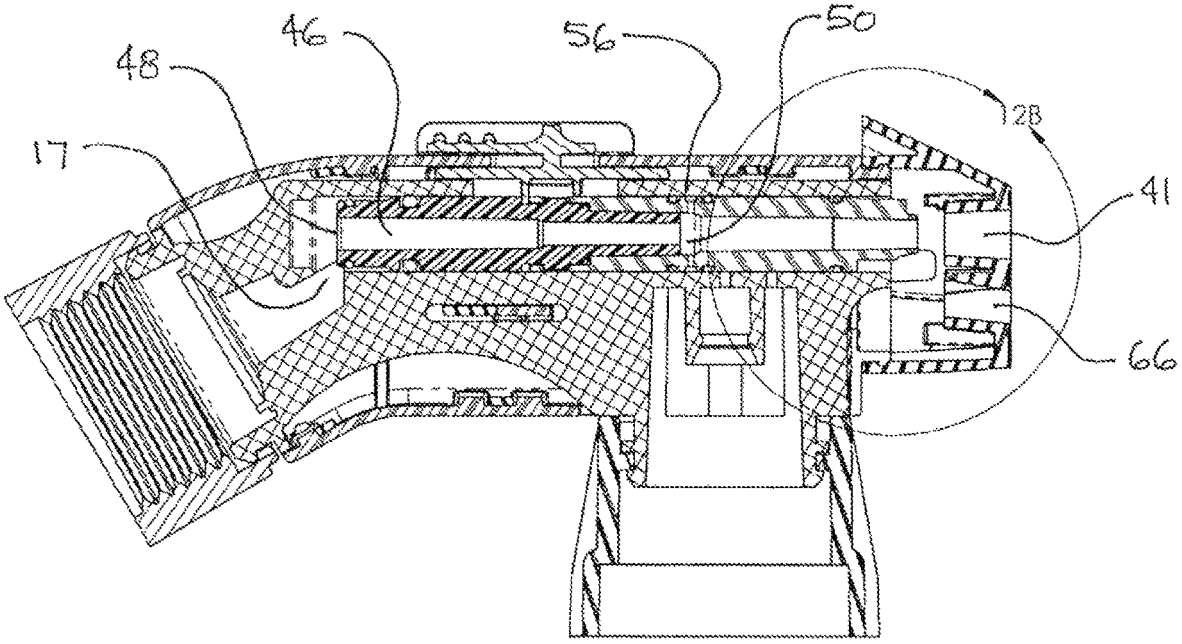
FIG. 12A shows a cross-sectional view of the assembled sprayer of FIG. 12.
Figure 12B:
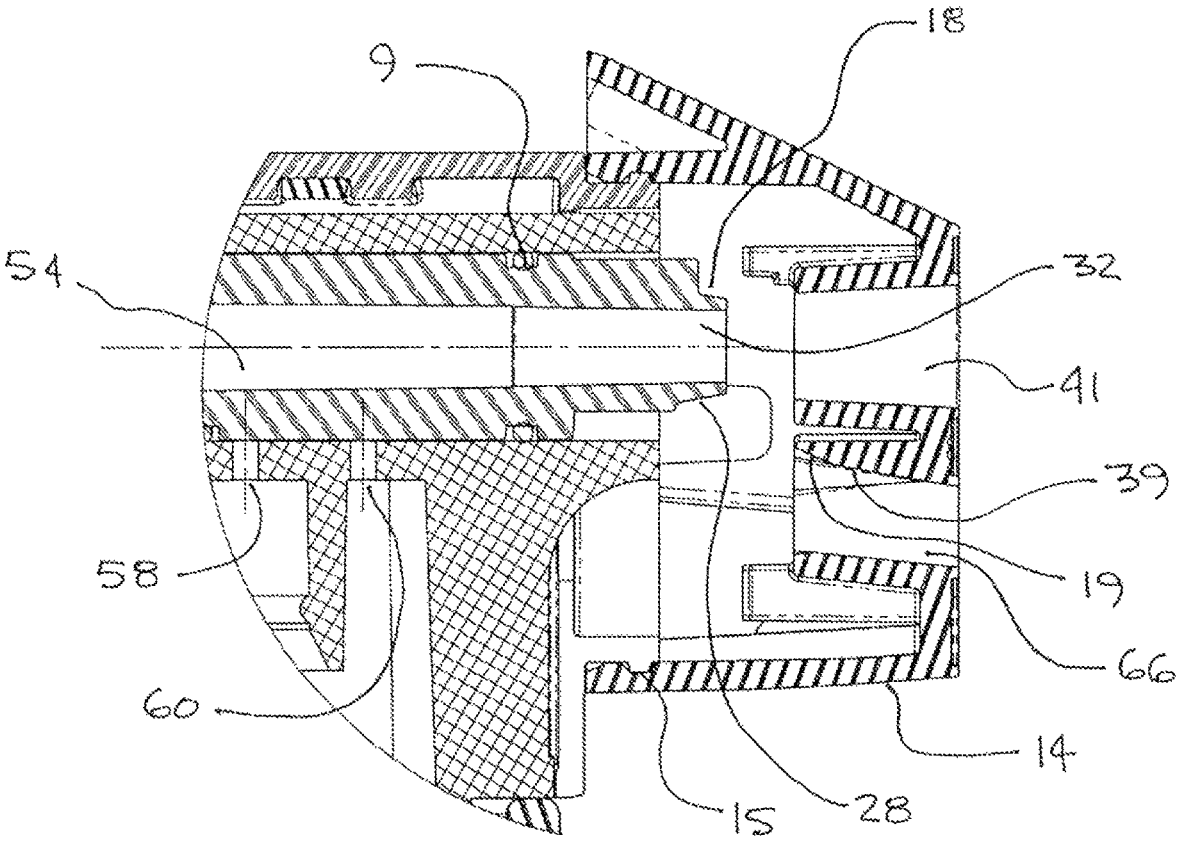
FIG. 12B shows a detailed view of area 12B of FIG. 12A.
Figure 13B:
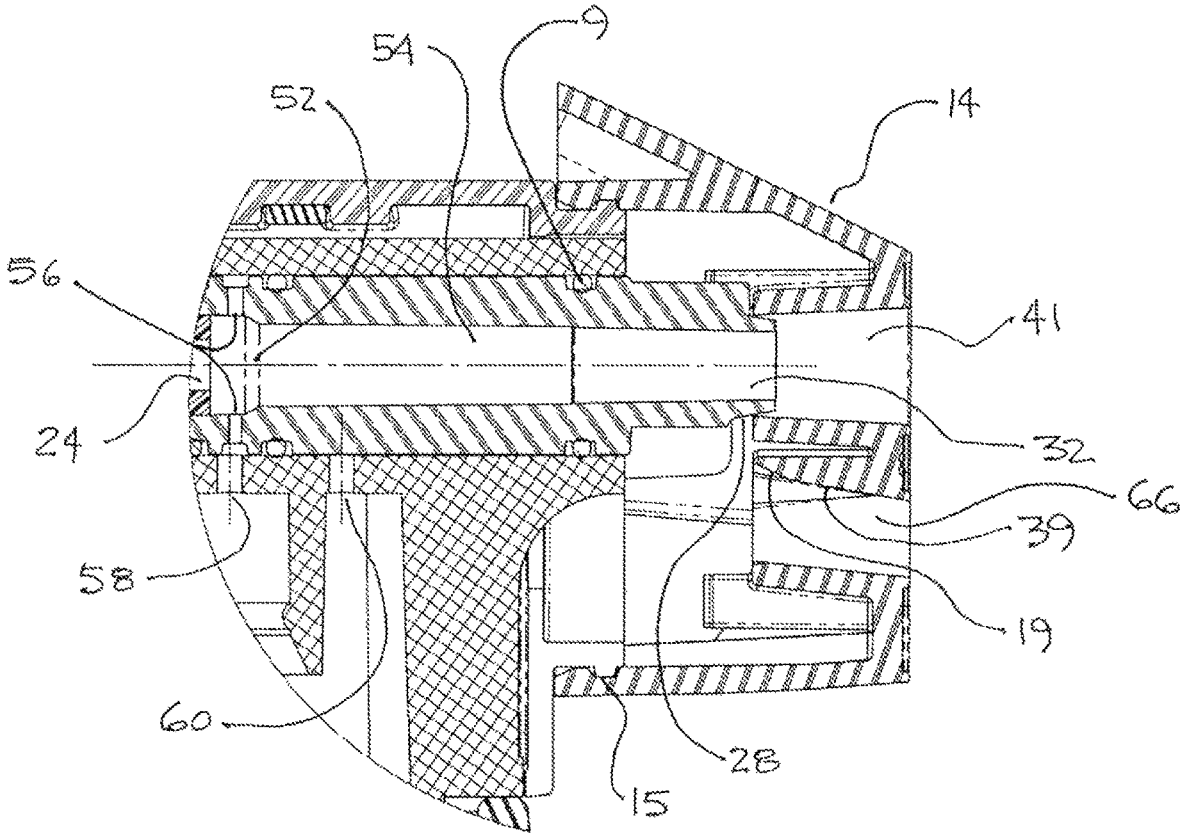
FIG. 13B shows a detailed view of area 13B of FIG. 13A.

When placing the convex tapered flow deflecting surface 39 into the flow stream, the positional accuracy required to create the optimum spray dispersion without causing undue side spray or misting can be a concern. With the number of parts in the assembly and with the tolerances required to manufacture each of these parts, once assembled there is a wide range of relative positions which could result between the flow stream exit and this flow interrupting surface. Hence, there was a need to devise an apparatus to increase the precision of the positional placement of the flow stream relative to the deflecting surface on the nozzle part. The solution was to incorporate a tapered cam ramp 19 into the convex tapered flow deflecting surface 39 which engages with the tapered end 28 of the tip 18 of flow tube assembly 1 such that the flow tube assembly 1 engages and is slightly lifted during movement from the no flow condition (FIGS. 8B and 11B) to the flow and dispense position (FIGS. 10B and 13B). This cam ramp 19 produces at least two effects, it raises the flow tube assembly 1 slightly and it forces the nozzle 14 downward slightly. The flow tube sealing arrangement, utilizing O-rings 5, 6, 7, 8, and 9 which all seal between the two-piece flow tube assembly 1 and the maim housing bore 25 of the main housing sub-assembly 10 combined with the diametric clearance between the outer diameter of the two-piece flow tube assembly 1 and the main housing bore 25 are adapted to allow the motion of the flow tube as it is raised during interference with the cam ramp 19 on the nozzle 14. Hence, the use of the O-rings allows the motion of the two-piece fluid tube assembly 1 perpendicular to the axis of the two-piece flow tube assembly while still providing the sealed conditions required for operational performance of the fluidic system. In addition, the flexible or resilient nature of the polymers used to manufacture the downstream flow tube assembly member 3 will allow slight flexure or bending of the member under the lifting force of the cam ramp 19 in conditions whereby the clearance between the outer diameter of the two-piece flow-tube assembly 1 and the main housing bore 25 is not sufficient to accommodate the total system tolerances. The net result is that the position of the flow exit from the exit bore 32 of flow tube assembly 1 is at the same relative distance from the convex tapered flow deflecting surface 39 on the nozzle 14 regardless of the assembly tolerances within the given assembly. This arrangement provides a substantially uniform mist and drip free fan spray from each assembly. Since each part of this assembly comes from at least four cavities, there are a multitude of possible cavity combinations in production. This cam action feature, which is used to remove the tolerance stack-up in the assembly, has removed a major potential quality issue.

Given the ability to rotate the nozzle 14 to select the desired flow condition, there may be a concern that the end-user may be in some danger of harm or getting really wet if they turned or rotated the nozzle 14 while the sprayer 16 is flowing water. To help prevent this potential hazard, features were developed and implemented in the present design that effectively lock the rotation of the nozzle 14 while the sprayer 16 is flowing water. Interlock ribs 62 on the nozzle 14 adjacent to convex tapered flow deflecting surface 39 are spaced a predetermined distance one from the other such that the gap between them is adapted to receive rib 30 on flow tube assembly 1 when the flow tube is moved from the OFF position to the ON/MIX position (see FIGS. 17-19). Interlock ribs 64 on the nozzle 14 adjacent to straight stream nozzle opening 41 are spaced a predetermined distance one from the other such that the gap between them, is adapted to receive locating rib 30 on How tube assembly 1 when the flow tube is moved from the OFF position to the ON/MIX position (see FIGS. 20-22).

The ability to tailor the shroud side covers 13*a*, 13*b* to different styles and designs for different customers, still using the inner skeleton for the flow performance, will allow one platform to be utilized for many potential customers or end-use applications. The positionable nozzle 14, allowing either a straight stream nozzle opening 41, or a distributed wide fan style of spray from a dispersed spray nozzle opening 66 having a convex tapered flow deflecting surface 39, and which is locked in positon during use, lends flexibility to the array of potential end use applications well.

Figure 8:
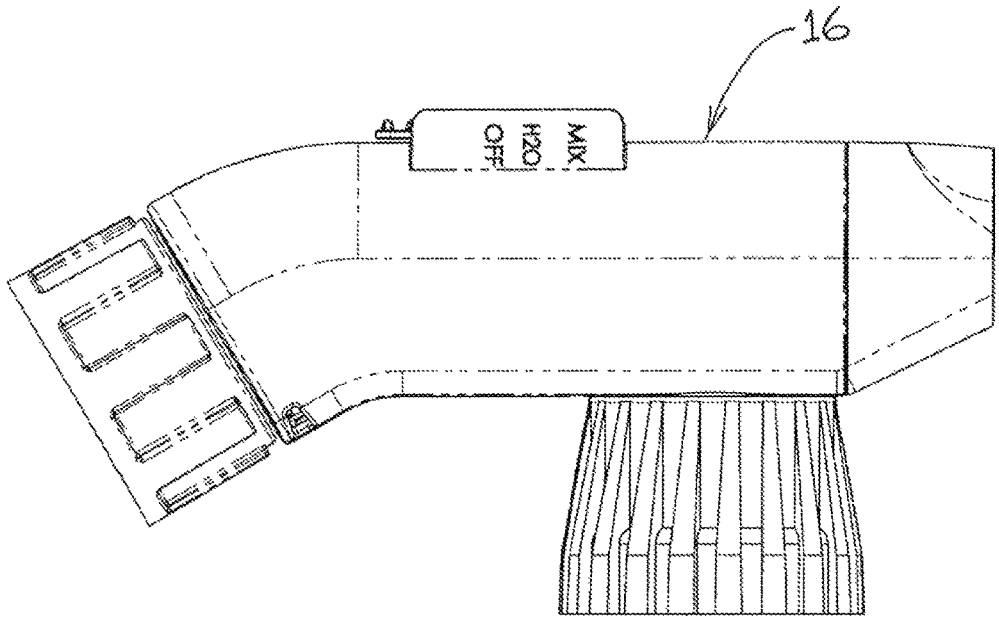
FIG. 8 shows a side view of the assembled sprayer in an OFF position.
Figure 8A:
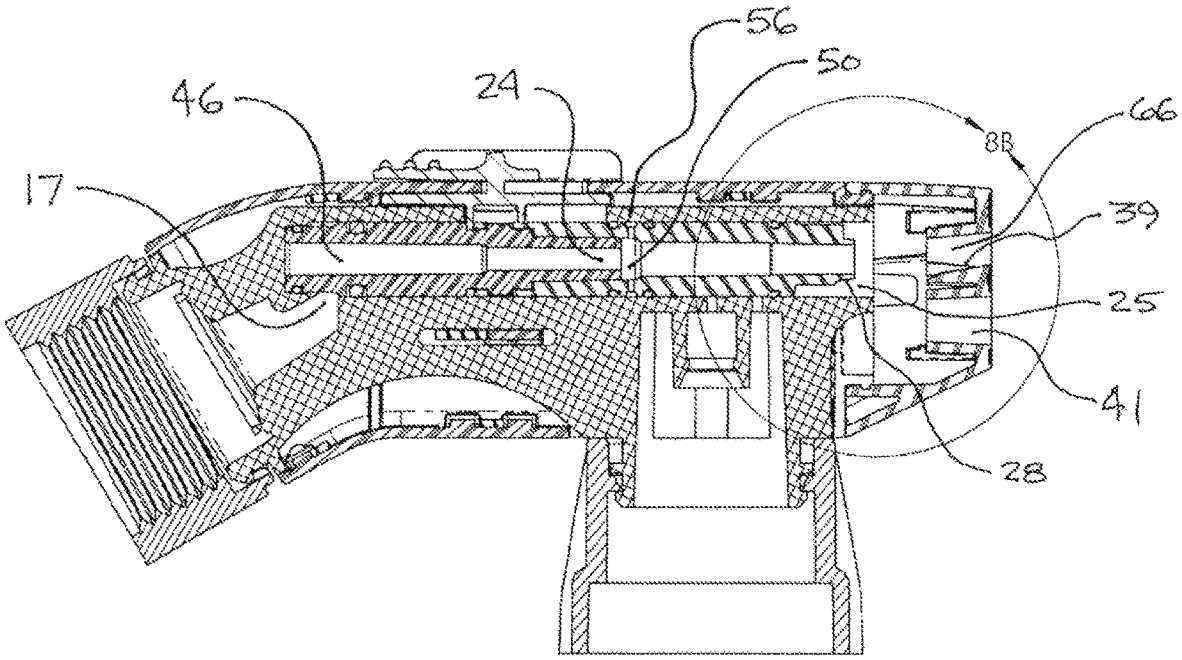
FIG. 8A shows a cross-sectional view of the assembled sprayer of FIG. 7.
Figure 8B:
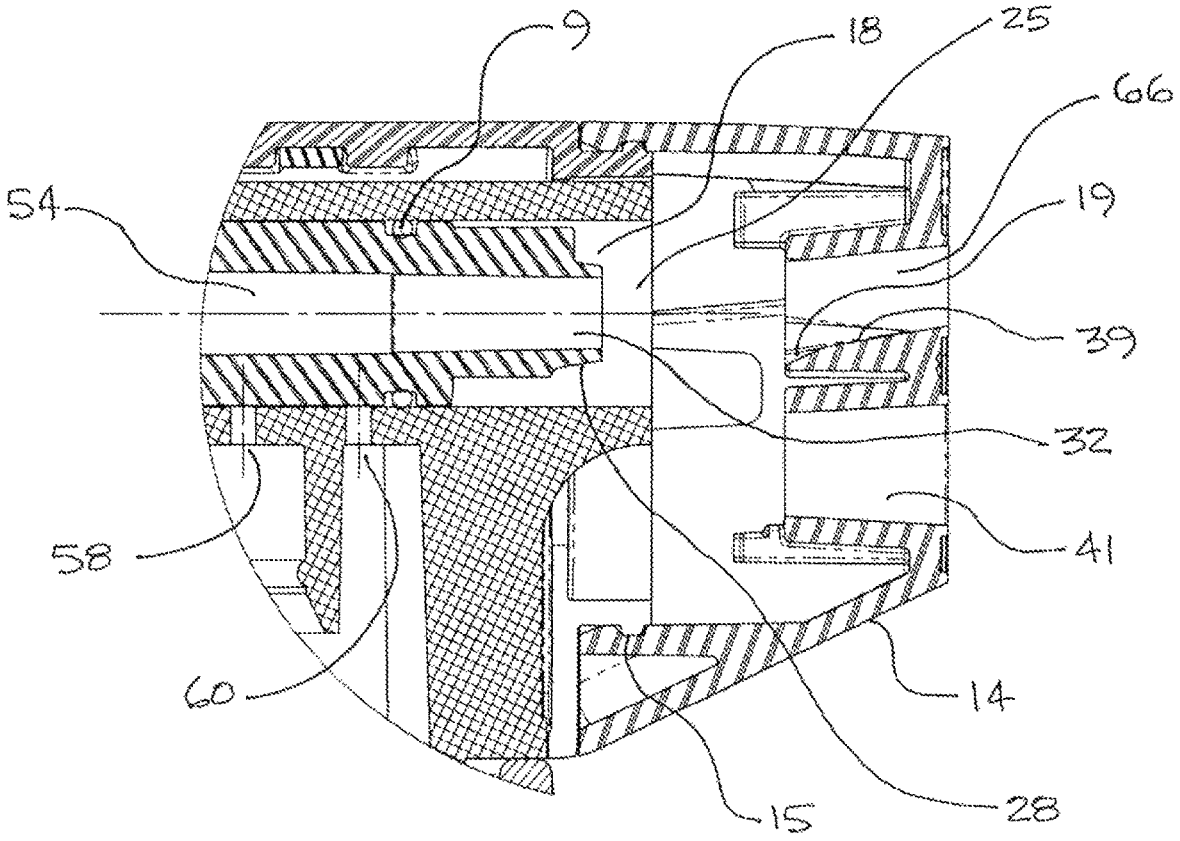
FIG. 8B shows a detailed view of area 8B of FIG. 8A.
Figure 9:
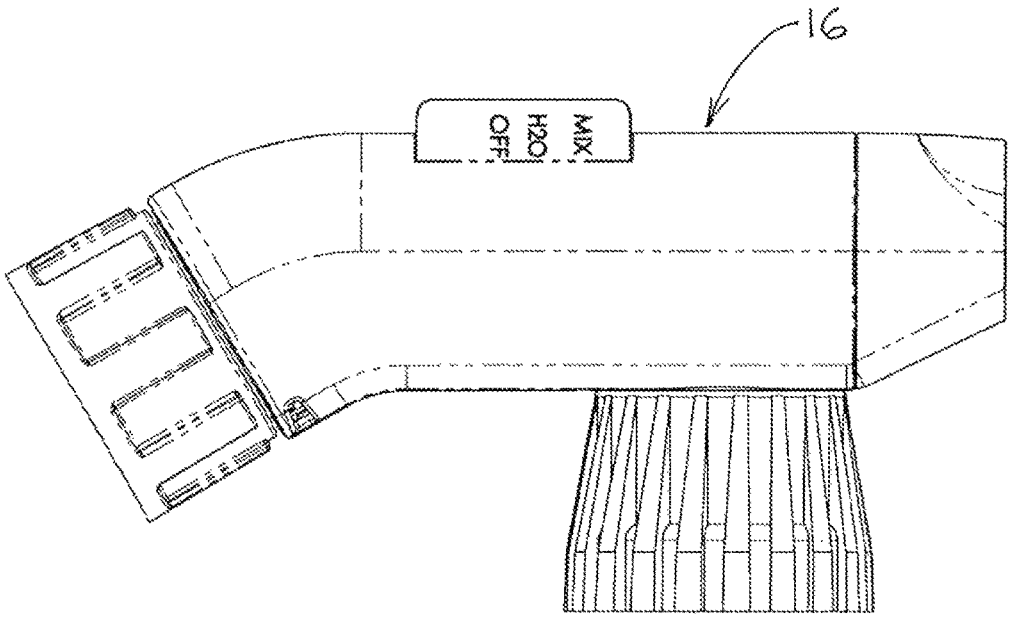
FIG. 9 shows a side view of the assembled sprayer in an H2O (water) Only position.
Figure 9A:
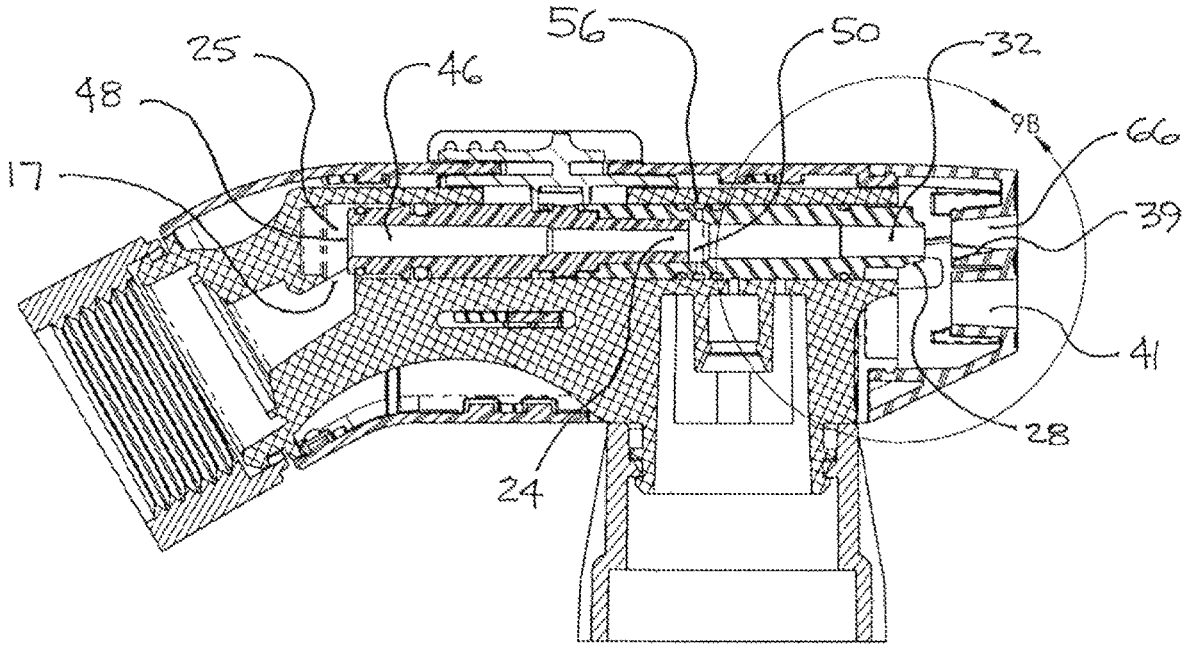
FIG. 9A shows a cross-sectional view of the assembled sprayer of FIG. 9.
Figure 9B:
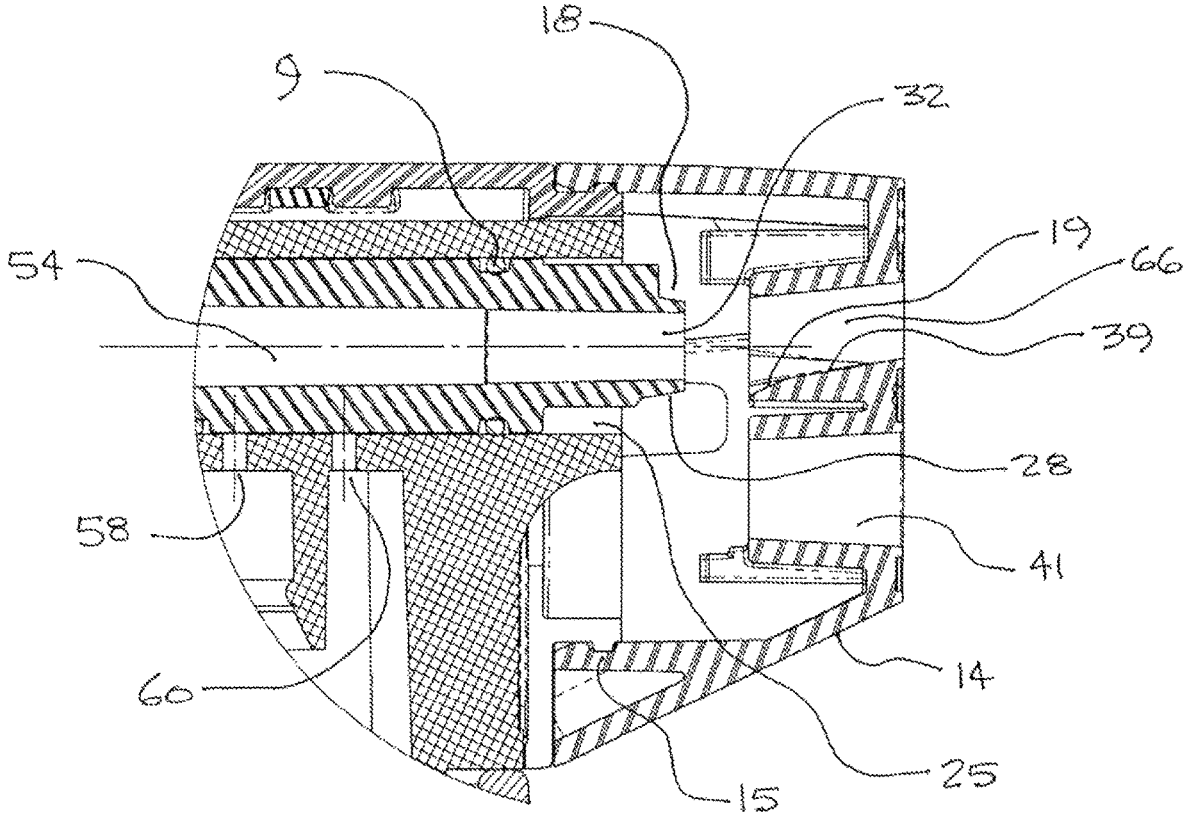
FIG. 9B shows a detailed view of area 9B of FIG. 9A.

Referring to FIGS. 8, 11, 14, 17, and 20, sprayer 16 is shown with flow tube assembly 1 in the OFF position as it is moved to the left most (upstream) position in this view. As shown in FIG. 8, flow tube assembly 1 blocks the flow of water from water inlet port 17 and the flow of chemicals from chemical port 58. As shown in FIGS. 8A and 8B, tip 18 of flow tube assembly 1 is not in contact with cam ramp 19 of nozzle 14.

Figure 14A:
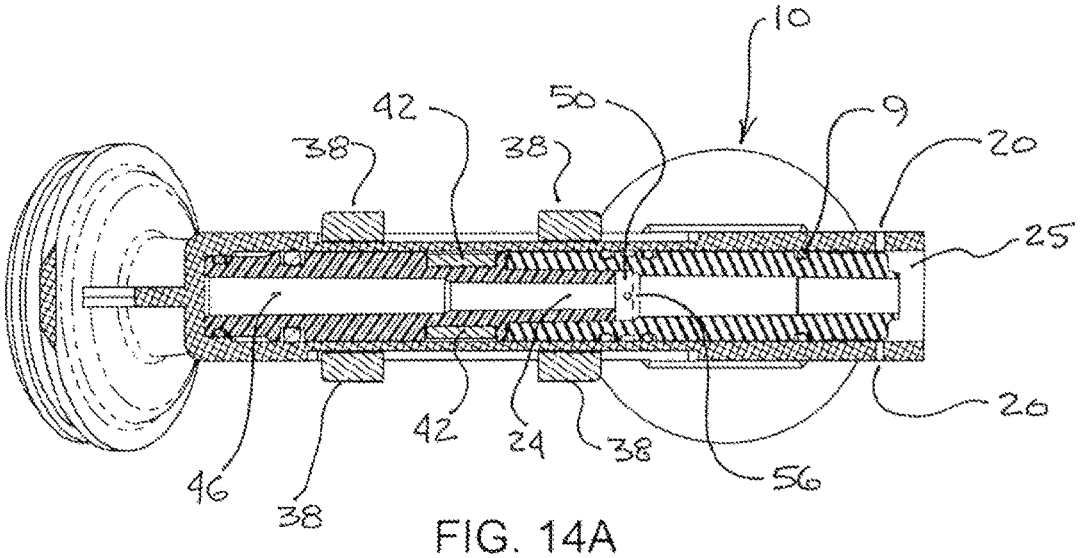
FIG. 14A is a cross-sectional view taken from FIG. 14.
Figure 14:
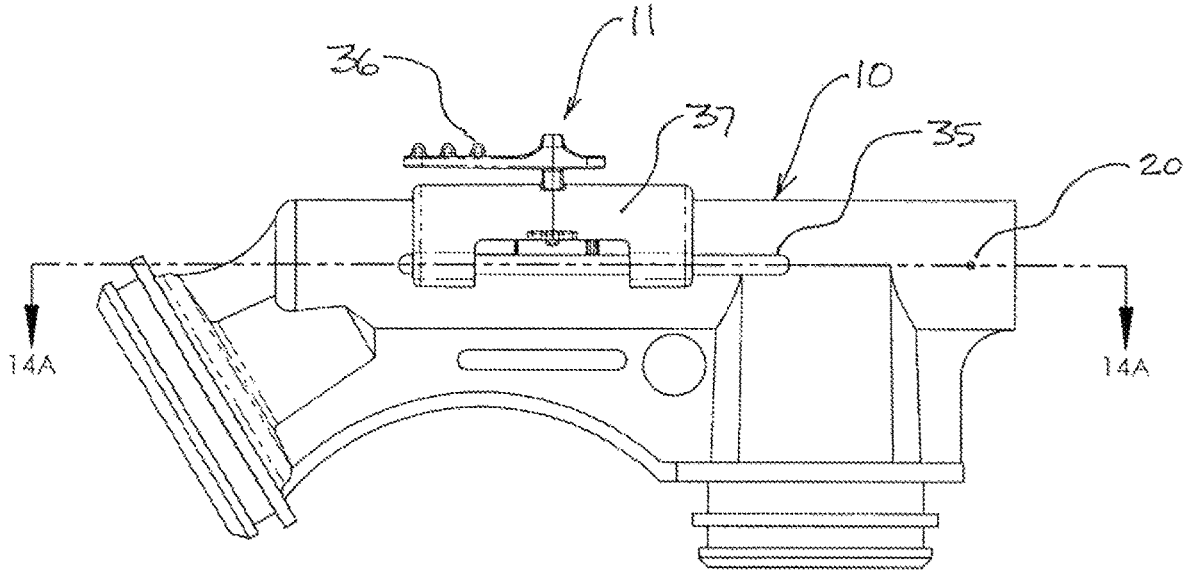
FIG. 14 is a side view of the main housing sub-assembly shown in the OFF position.
Figure 15A:
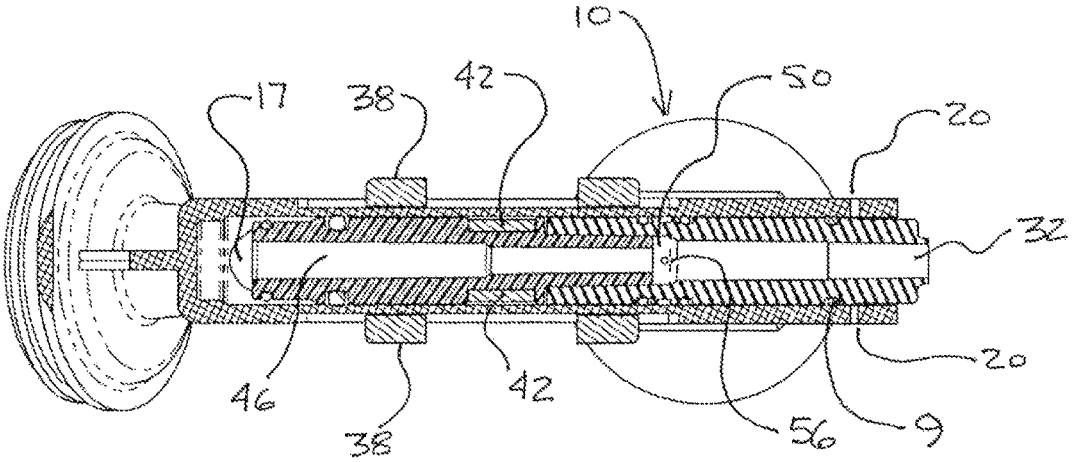
FIG. 15A is a cross-sectional view taken from FIG. 15.
Figure 15:
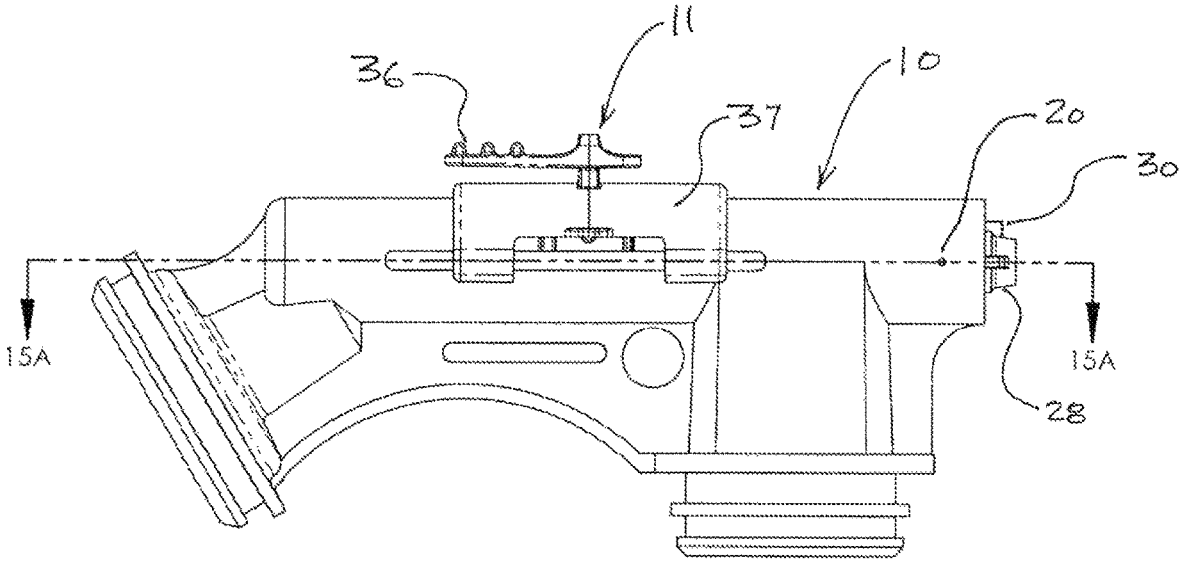
FIG. 15 is a side view of the main housing sub-assembly shown in the H2O (water) Only position.

In FIGS. 14 and 14A, sprayer 16 is shown with flow tube assembly 1 in the OFF position and with the external shroud 26 removed, and with the chemical container attachment swivel and hose attachment swivel removed. FIG. 14A shows the vent O-ring 9 on the flow tube assembly 1 to the left (in this view) of vent ports 20 in the main housing sub-assembly 10 thereby preventing fluid communication between the vent hole 60 and vent ports 20 rendering the container blocked from fluid communication with the atmosphere outside the container. The vent ports 20 (FIGS. 5, 6, and 14-16A) are a pair of circular holes, one on each side of main housing sub-assembly 10, near the fluid exit from the sprayer 16. Vent ports 20 control the access to atmosphere through the sprayer 16 and for the chemical container (not shown) to supply atmospheric pressure to motivate the fluid contents of the container when the sprayer 16 is in the ON/MIX position and the venturi chamber 50 is at a less than atmospheric pressure condition. The vent ports 20 extend between the main bore 25 and the exterior of main housing sub-assembly 10 (atmosphere). In the OFF position, the vent O-ring 9 is preventing fluid communication between the inside of the chemical container through atmospheric vent hole 60, vent ports 20 and the atmosphere. In the ON/MIX position. O-Ring 9 has passed over vent ports 20 and now allows fluid communication through the annual space between the exterior diameter of flow tube portion 3 and the inner bore 25 of main housing sub-assembly 10 and through vent port 60 into the chemical container (not shown).

Referring to FIGS. 10, 13, 16, 19, and 22, sprayer 16 is shown with flow tube assembly 1 in the ON/MIX position as it is moved to she right most (downstream) position. As shown in FIGS. 10A and 10B, the water inlet port 17 is now open allowing water to flow through sprayer 16, and chemical inlet port 58 is in fluid connection with apertures 56 in downstream flow tube assembly member 3. As shown in FIG. 10B, tip 18 of flow tube assembly 1 is contacting cam ramp 19 of nozzle 14. The flow tube assembly 1 may actually move upward as a result of contacting cam ramp 19. FIG. 10B shows the interference of the two parts. As the flow tube assembly 1 is moved downstream, it rides up the cam ramp 19 and is lifted vertically by the magnitude of the interference shown by around 0.010 inches in one embodiment. The nozzle 14 may be pushed downward some small magnitude simultaneously during the cam action, however the net result of the slight lifting of the flow tube assembly 1 and the slight lowering of the nozzle 14 is to set the relative distance between the flow exit position from exit bore 32 and the convex tapered flow deflecting surface 39 on the nozzle 14 to which the flow impinges. This combined motion from the cam action sets the exiting water flow to a particular position relative to the convex tapered flow deflecting surface 39 on the nozzle 14 which it imparts, thereby removing the assembly to assembly variances due to the tolerances inherent in the many parts molded from the many cavities which make-up the final assemblies.

Figure 16A:
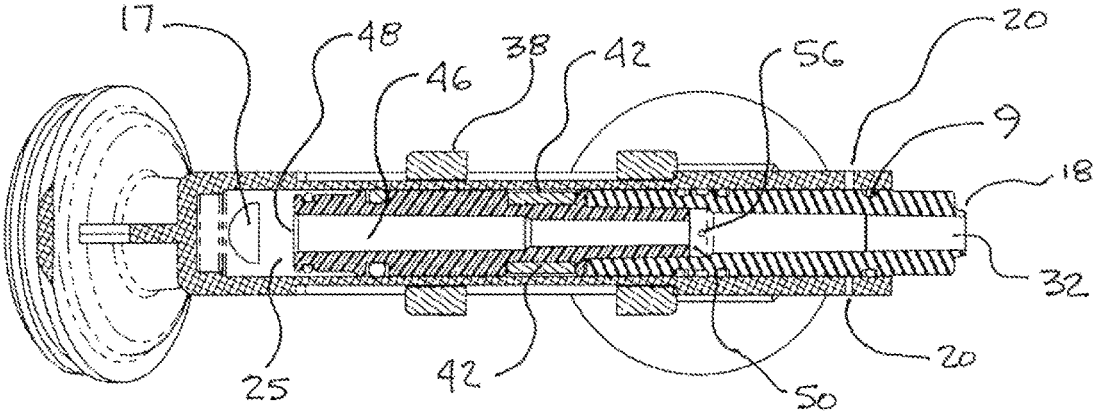
FIG. 16A is a cross-sectional view taken from FIG. 16.
Figure 16:
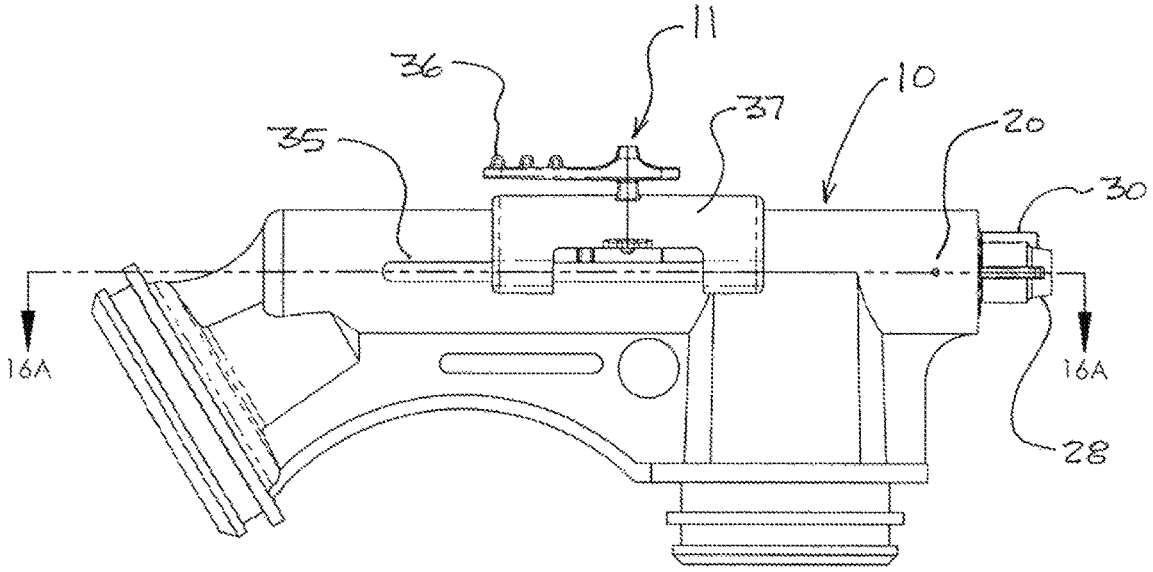
FIG. 16 is a side view of the main housing sub-assembly shown in the ON/MIX position.
Figure 17:
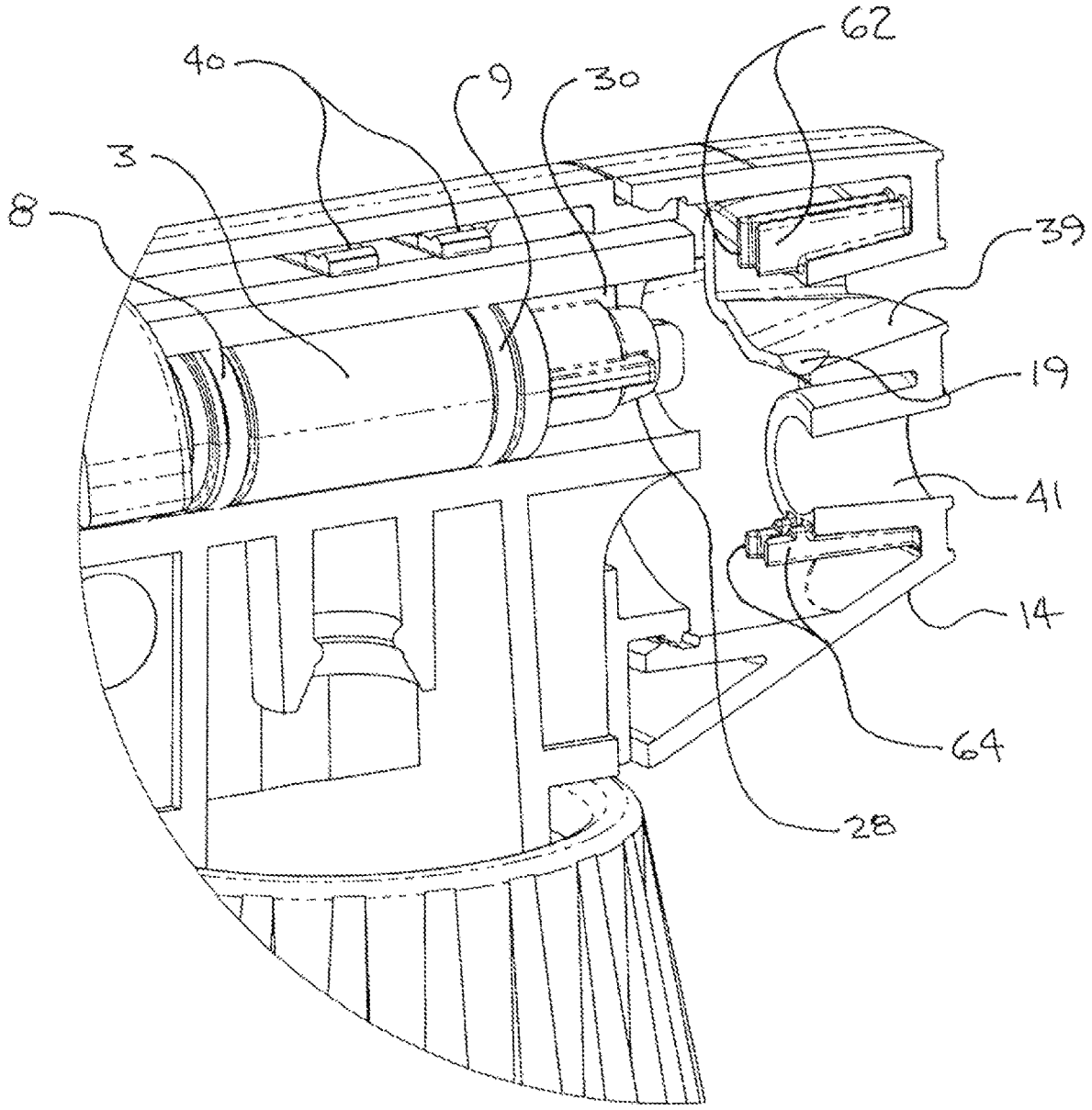
FIG. 17 is a detailed perspective sectioned view showing the relationship of the flow tube to the nozzle when the sprayer is in the OFF position.
Figure 18:
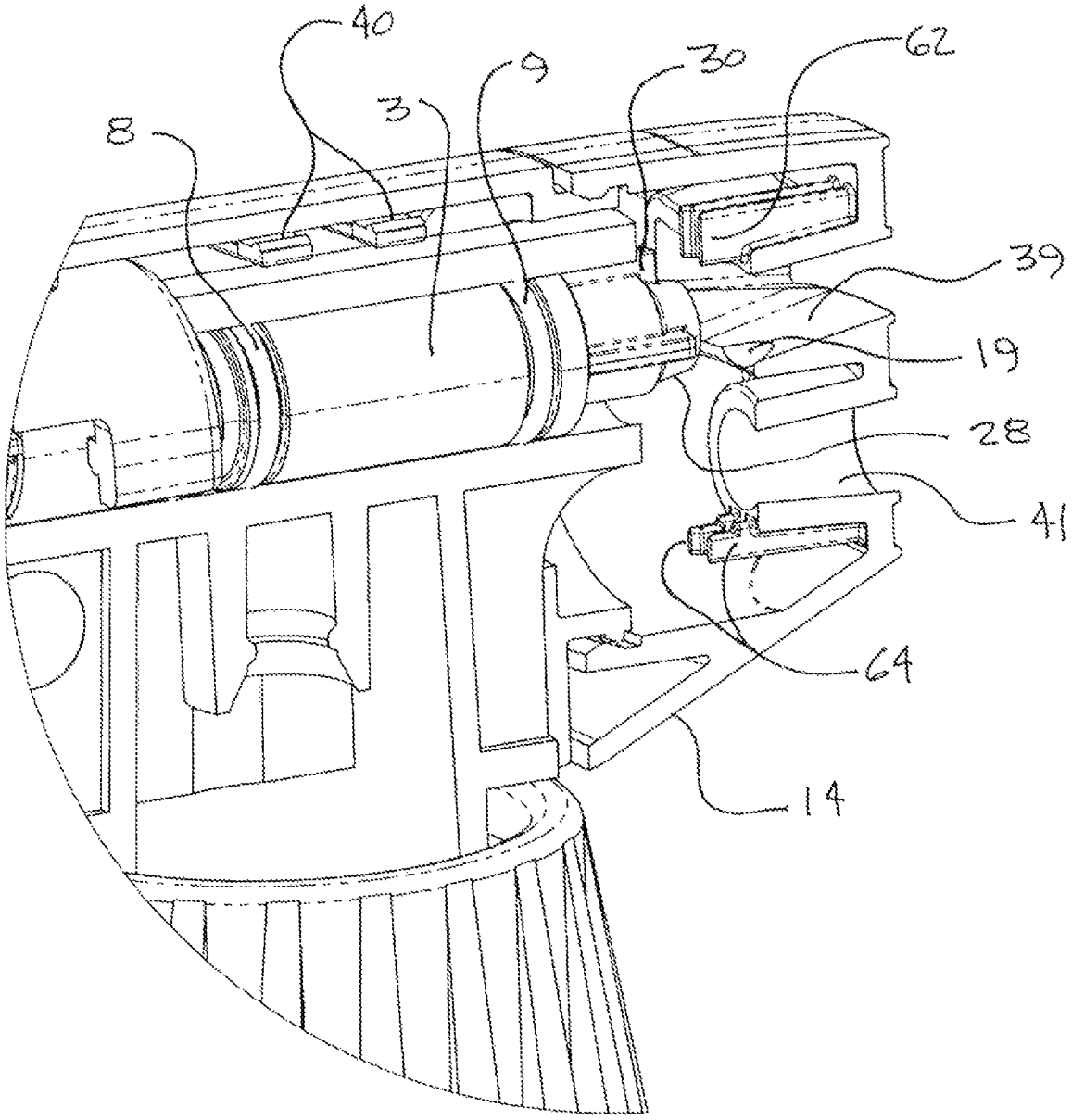
FIG. 18 is a detailed perspective sectioned view showing the relationship of the flow tube to the nozzle when the sprayer is in the H2O (water) ONLY position.
Figure 19:
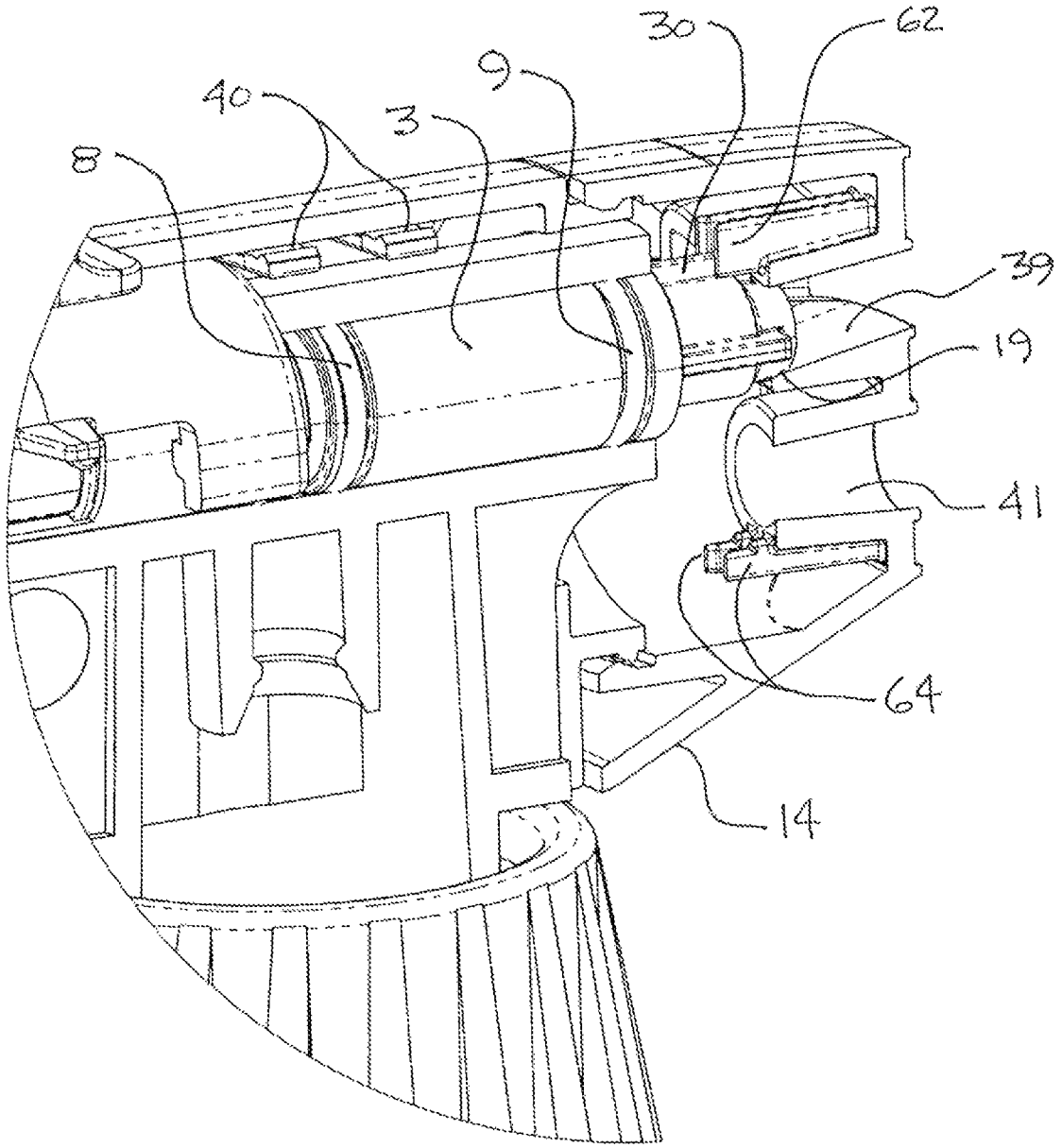
FIG. 19 is a detailed perspective sectioned view showing the relationship of the flow tube to the nozzle when the sprayer is in the ON/MIX position.
Figure 20:
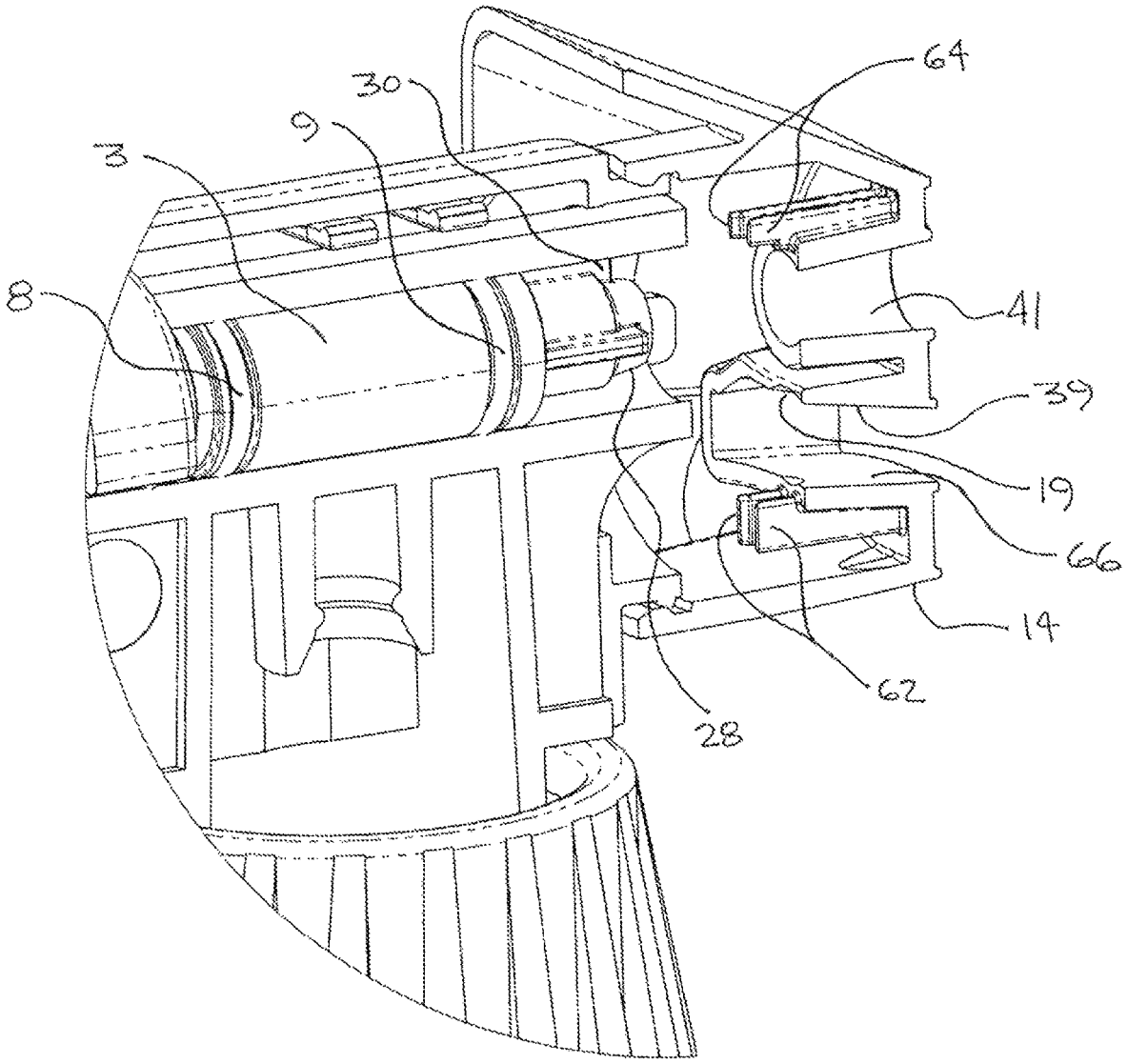
FIG. 20 is a detailed perspective sectioned view showing the relationship of the flow tube to the nozzle when the sprayer is in the OFF position and the nozzle is rotated to the straight stream position.
Figure 21:
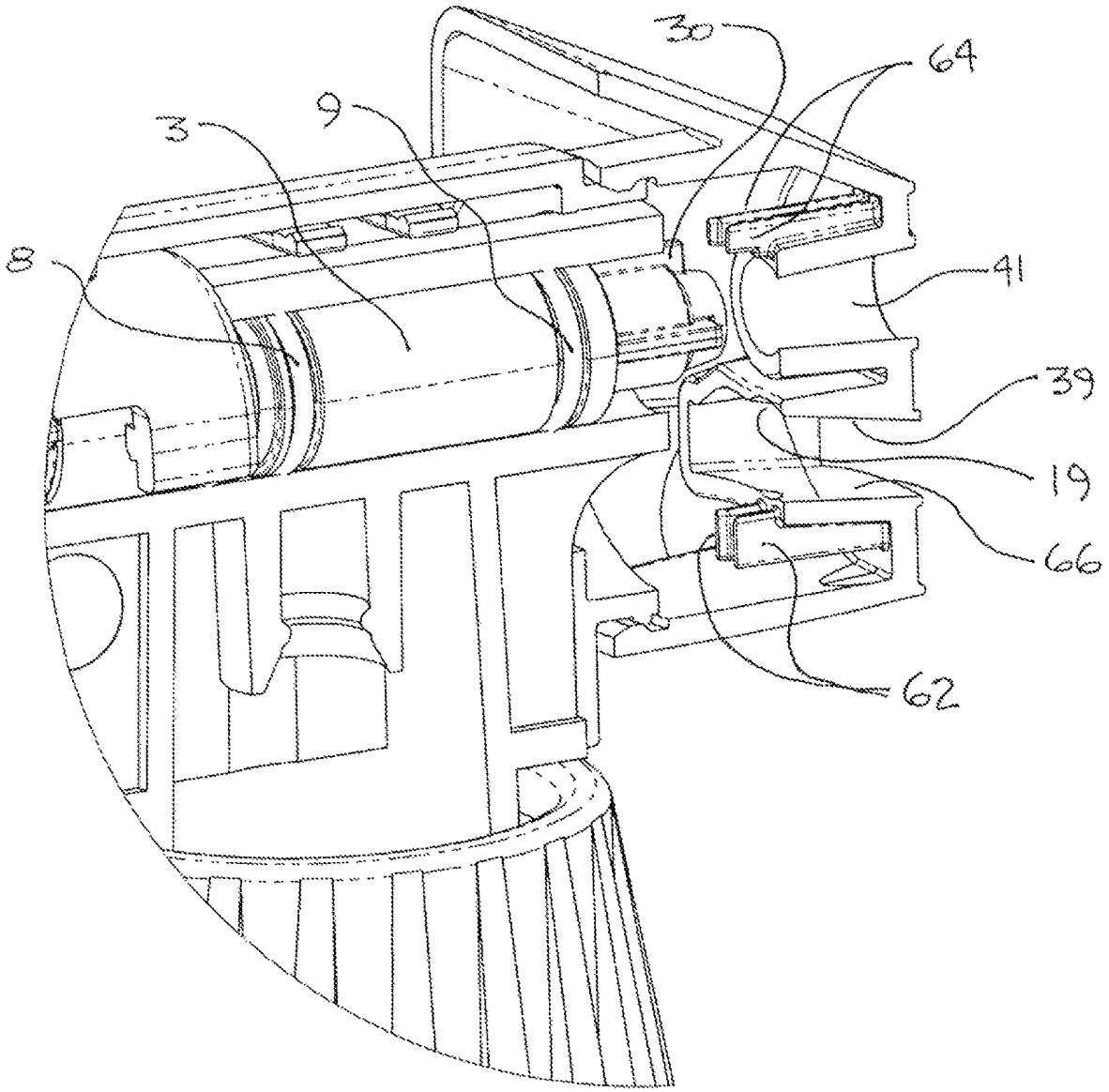
FIG. 21 is a detailed perspective sectioned view showing the relationship of the flow tube to the nozzle when the sprayer is in the H2O (water) ONLY position and the nozzle is rotated to the straight stream position.
Figure 22:
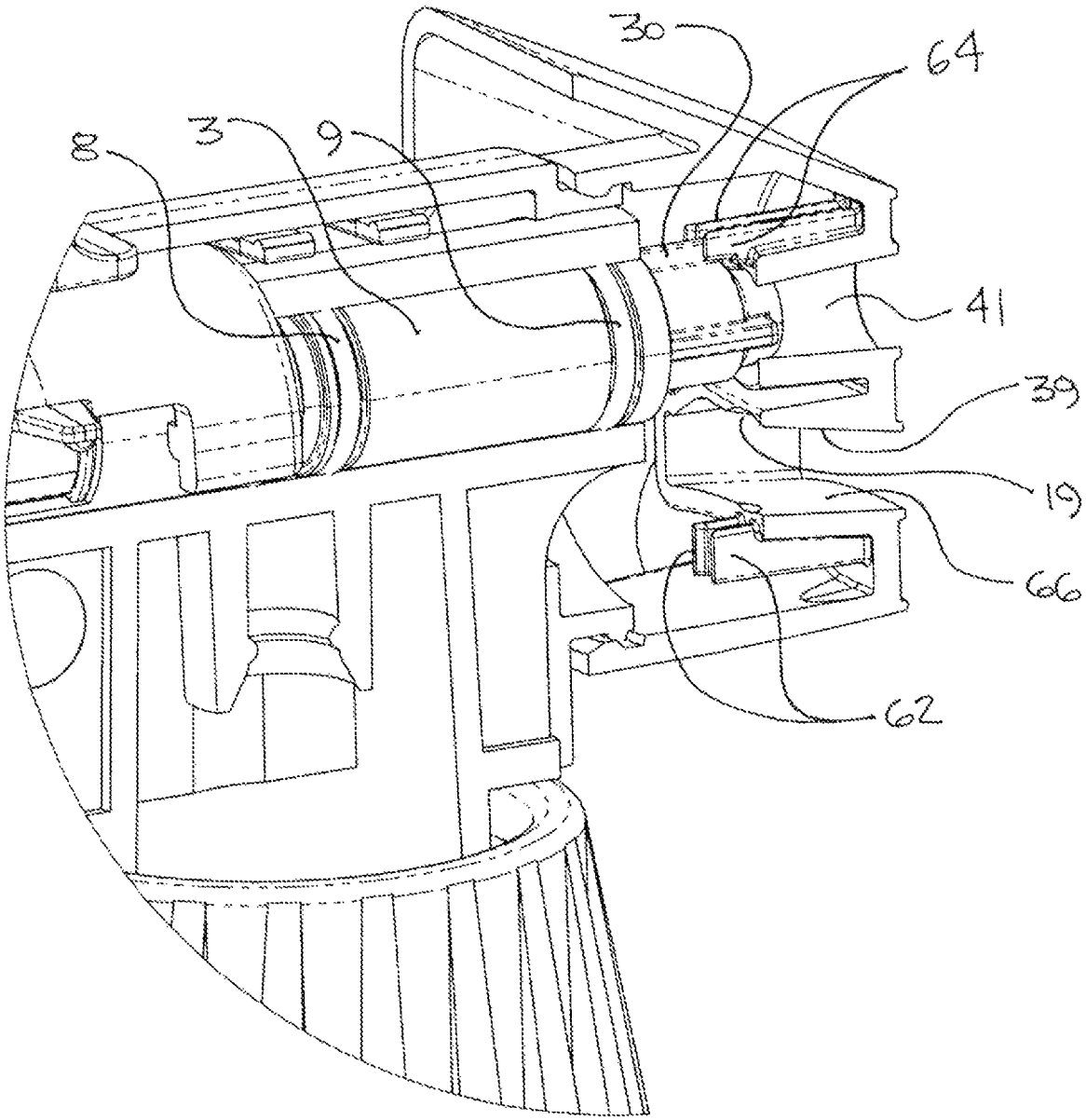
FIG. 22 is a detailed perspective sectioned view showing the relationship of the flow tube to the nozzle when the sprayer is in the ON/MIX position and the nozzle is rotated to the straight stream position.

In FIGS. 16 and 16A, sprayer 16 is shown with flow tube assembly the flow tube assembly 1 in the ON/MIX position and with the external shroud 26 and hose and container threaded connections removed. FIG. 16A shows the vent O-ring 9 on the flow tube assembly 1 to the right (in this view) of the vent port 20 in the main housing 10 thereby allowing fluid communication between the inside of the container (not shown) to which the sprayer 16 is attached and the atmosphere.

In order for the sprayer 16 to work properly two conditions must be met, first the venturi chamber 50 must produce a pressure drop when the water is flowing through the fluidic chambers of flow tube assembly 1; and second, atmospheric pressure must be allowed to act on the top of the fluid within the container to be mixed and diluted with the flowing water. However, the concentrated chemical fluid contents within the container to which the sprayer assembly is attached must be prevented from substantially leaking after filling and at any time when not in use. Hence, the fluid communication between the inside of the container and atmosphere must be gated or controlled—opened when water is flowing and closed at all other times. The two-piece flow tube assembly 1 when combined with the vent ports 20 within the main housing bore 25 of main housing sub-assembly 10 accomplishes this task.

In the $H_2O$ position (FIGS. 9,12, 15, 18 and 21), flow tube assembly 1 is disposed between the OFF position and the ON/MIX positions such that the water inlet port 17 is open allowing water to flow through sprayer 16, and the chemical inlet port 58 is blocked.

Although the apparatus, assembly and use has been described and depicted in detail for the purpose of illustration, it is to be understood that such detail is solely for that purpose and that numerous modifications, alterations and changes can be made therein by those skilled in the art without departing from the spirit and scope of the inventions disclosed herein.

What is claimed is:

1. A hose end sprayer configured for connecting to a hose and at least one container, the hose end sprayer comprising:

a main housing sub-assembly having a main housing bore, wherein the main housing bore has a first main bore inlet configured to accept a first substance from the hose, a second main bore inlet configured to accept a second substance from the container, and a main bore outlet;

a flow tube assembly disposed within the main housing bore and slideably displaceable relative thereto between a first position allowing delivery of neither of the first substance and the second substance through the main bore outlet, and a second position allowing delivery of a mixture of the first and second substances through the main bore outlet, wherein the flow tube assembly has an upstream end and a downstream end;

a nozzle disposed at the outlet of the main housing bore, wherein the nozzle includes an interference member configured to selectively engage with and move the downstream end of the flow tube assembly when the flow tube assembly is in the second position.

2. The hose end sprayer of claim 1, wherein the flow tube assembly is displaceable to a third position allowing delivery of solely the first substance through the main bore outlet.

3. The hose end sprayer of claim 1, wherein the nozzle is configured to alter a flow of at least one of the first substance and the second substance delivered though the main bore outlet.

4. The hose end sprayer of claim 3, wherein the nozzle further comprises a first nozzle opening and a second nozzle opening.

5. The hose end sprayer of claim 4, wherein the nozzle is positionable between a first nozzle position in which the first nozzle opening is in fluid communication with the main bore outlet, and a second nozzle position in which the second nozzle opening is in fluid communication with the main bore outlet.

6. The hose end sprayer of claim 5, wherein the first nozzle position corresponds to a first spray pattern and the second nozzle position corresponds to a second spray pattern.

7. The hose end sprayer of claim 6, wherein the first spray pattern is a dispersed spray pattern and wherein the second spray pattern is a straight stream pattern.

8. The hose end sprayer of claim 7, wherein the interference member is configured to engage with and move the downstream end of the flow tube assembly when the flow tube assembly is in the second position and when the nozzle is in the first nozzle position.

9. The hose end sprayer of claim 8, wherein the interference member comprises a convex tapered surface.

10. A hose end sprayer configured for connecting to a hose and at least one container, the hose end sprayer comprising:

a main housing sub-assembly having a main housing bore, wherein the main housing bore has a first main bore inlet configured to accept a first substance from the hose, a second main bore inlet configured to accept a second substance from the container, and a main bore outlet;

a flow tube assembly disposed within the main housing bore and slideably displaceable relative thereto between a first position allowing delivery of neither of the first substance and the second substance through the main bore outlet, and a second position allowing delivery of a mixture of the first and second substances through the main bore outlet, wherein the flow tube assembly has an upstream end and a downstream end;

a nozzle disposed at the outlet of the main housing bore, wherein the nozzle includes an interference member configured to selectively interfere with the downstream end of the flow tube assembly when the flow tube assembly is in the second position;

wherein the nozzle is configured to alter a flow of at least one of the first substance and the second substance delivered though the main bore outlet;

wherein the nozzle further comprises a first nozzle opening and a second nozzle opening;

wherein the nozzle is positionable between a first nozzle position in which the first nozzle opening is in fluid communication with the main bore outlet, and a second nozzle position in which the second nozzle opening is in fluid communication with the main bore outlet;

wherein the first nozzle position corresponds to a first spray pattern and the second nozzle position corresponds to a second spray pattern;

wherein the first spray pattern is a dispersed spray pattern and wherein the second spray pattern is a straight stream pattern;

wherein the interference member is configured to interfere with the downstream end of the flow tube assembly when the flow tube assembly is in the second position and when the nozzle is in the first nozzle position;

wherein the interference member comprises a convex tapered surface; and wherein the convex tapered surface includes a cam ramp configured to lift the downstream end of the flow tube assembly and lower the nozzle when the flow tube assembly is in the second position.

11. The hose end sprayer of claim 5, wherein the nozzle is configured to be rotatably attached to the main housing sub-assembly.

12. The hose end sprayer of claim 11, wherein the nozzle is a component of an external shroud configured to be removeably attached to the main housing sub-assembly.

13. The hose end sprayer of claim 12, wherein the external shroud further comprises first and second side pieces.

14. The hose end sprayer of claim 11, wherein the downstream end of the flow tube assembly includes at least one locating rib, and wherein the nozzle further includes at least one pair of interlock ribs, and wherein the at least one locating rib is configured to engage between a corresponding pair of interlock ribs when the flow tube assembly is in the second position.

15. The hose end sprayer of claim 1, wherein the downstream end of the flow tube assembly has an externally tapered surface, and wherein the interference member is configured to engage the externally tapered surface.

16. The hose end sprayer of claim 1, wherein the flow tube assembly further comprises at least one seal member between the flow tube assembly and the main housing bore.

17. The hose end sprayer of claim 16, wherein the at least one seal member is at least one O-ring.

18. The hose end sprayer of claim 1, wherein the flow tube assembly further comprises an upstream flow assembly member and a downstream flow assembly member, wherein the upstream flow assembly member is non-unitary with the downstream flow assembly and is configured to be connected to the downstream flow assembly member.

19. The hose end sprayer of claim 18, wherein the upstream flow assembly member has a tapered male seal end which is configured to be insertable into a female seal end of the downstream flow tube assembly member.

20. The hose end sprayer of claim 19, wherein the upstream flow assembly member and the downstream flow assembly member are configured to be connected together by a latch assembly.

21. The hose end sprayer of claim 20, wherein the latch assembly comprises at least one oval boss projections on upstream flow tube assembly member and at least one corresponding oval slot on downstream flow assembly.

22. The hose end sprayer of claim 18, wherein the upstream flow tube assembly member comprises a tapered inlet chamber and a throttle exit.

23. The hose end sprayer of claim 22, wherein the downstream flow tube assembly comprises a venturi chamber and a tapered outlet chamber of decreasing diameter extending from a transition chamber to an outlet flow bore.

24. The hose end sprayer of claim 18, further comprising an actuator configured to displace the flow tube assembly within the main housing bore.

25. The hose end sprayer of claim 24, wherein the actuator comprises a thumb actuator portion attached to a semi-cylindrical portion, wherein the semi-cylindrical portion includes opposed projections configured to be received in corresponding grooves on the main housing sub-assembly.

26. The hose end sprayer of claim 25, wherein the semi-cylindrical portion further comprises at least one prong configured to cooperate with at least one prong receiver recesses on the flow tube assembly.

27. A hose end sprayer configured for connecting to a hose and at least one container, the hose end sprayer comprising:

a main housing sub-assembly having a main housing bore, wherein the main housing bore has a first main bore inlet configured to accept a first substance from the hose, a second main bore inlet configured to accept a second substance from the container, and a main bore outlet;

a flow tube assembly disposed within the main housing bore and slideably displaceable relative thereto between a first position allowing delivery of neither of the first substance and the second substance through the main bore outlet, and a second position allowing delivery of a mixture of the first and second substances through the main bore outlet, wherein the flow tube assembly has an upstream end and a downstream end; and a nozzle disposed at the outlet of the main housing bore;

wherein the flow tube assembly comprises an upstream flow assembly member and a downstream flow assembly member configured to be connected together; and wherein the upstream flow assembly member has a tapered male seal end which is configured to be insertable into a female seal end of the downstream flow tube assembly member;

wherein the main housing bore is configured to prevent the upstream flow assembly member and the downstream flow assembly member from disconnecting when inserted in the main housing bore.

28. The hose end sprayer of claim 27, wherein the upstream flow assembly member and the downstream flow assembly member are configured to be connected together by a latch assembly.

29. The hose end sprayer of claim 28, wherein the latch assembly comprises at least one oval boss projections on upstream flow tube assembly member and at least one corresponding oval slot on downstream flow assembly.

* * * * *